US010796680B2

(12) United States Patent
Fang et al.

(10) Patent No.: US 10,796,680 B2
(45) Date of Patent: Oct. 6, 2020

(54) SOUND ABSORBER WITH STAIR-STEPPING STRUCTURE

(71) Applicant: The Hong Kong University of Science and Technology, Hong Kong (CN)

(72) Inventors: Yi Fang, Hong Kong (CN); Xin Zhang, Hong Kong (CN)

(73) Assignee: The Hong Kong University of Science and Technology, Hong Kong (CN)

( * ) Notice: Subject to any disclaimer, the term of this patent is extended or adjusted under 35 U.S.C. 154(b) by 443 days.

(21) Appl. No.: 15/784,385

(22) Filed: Oct. 16, 2017

(65) Prior Publication Data

US 2019/0115002 A1 Apr. 18, 2019

(51) Int. Cl.
*G10K 11/16* (2006.01)
*G10K 11/162* (2006.01)
*G10K 11/175* (2006.01)

(52) U.S. Cl.
CPC ..... *G10K 11/162* (2013.01); *G10K 11/175* (2013.01)

(58) Field of Classification Search
CPC .... G10K 11/172; G10K 11/175; G10K 11/16; G10K 11/161; G10K 11/04; G10K 11/02; G10K 11/002
See application file for complete search history.

(56) References Cited

U.S. PATENT DOCUMENTS 1,875,074 A * 8/1932 Mason ..... E04B 1/86 181/293
3,786,898 A * 1/1974 Fujii ..... E04B 1/8404 181/295
3,866,001 A * 2/1975 Kleinschmidt ..... E04B 1/8404 181/285
3,948,346 A 4/1976 Schindler
4,091,892 A * 5/1978 Hehmann ..... F02K 1/827 181/212
4,244,439 A * 1/1981 Wested ..... E01F 8/0094 181/210
4,296,831 A * 10/1981 Bennett ..... F02B 77/13 181/224
4,821,839 A * 4/1989 D'Antonio ..... E04B 1/86 181/198

(Continued)

FOREIGN PATENT DOCUMENTS

CN 102682759 A 9/2012
HK 1216447 A1 11/2016
WO 2007/073732 A2 7/2007

OTHER PUBLICATIONS

Cummer, Steven A. et al., "Controlling sound with acoustic metamaterials," Nature Reviews Materials, 2016, 1(16001):1-13, Macmillan Publishers Limited.

(Continued)

*Primary Examiner* — Edgardo San Martin
(74) *Attorney, Agent, or Firm* — Saliwanchik, Lloyd & Eisenschenk

(57) ABSTRACT

A sound absorber can include a back wall, a plurality of absorber elements disposed on the back wall and arranged periodically in a first direction, and a plurality of frames disposed between the plurality of absorber elements. The plurality of absorber elements can make a periodic metasurface due to a different thickness. The plurality of absorber elements can be made of a porous material.

18 Claims, 16 Drawing Sheets

(56) References Cited

U.S. PATENT DOCUMENTS

| | | | | |
|---|---|---|---|---|
| 5,401,921 | A * | 3/1995 | D'Antonio | G10K 11/20 181/286 |
| 5,512,715 | A * | 4/1996 | Takewa | E04B 1/86 181/286 |
| 6,290,022 | B1 * | 9/2001 | Wolf | G10K 11/172 181/286 |
| 6,450,289 | B1 * | 9/2002 | Field | F24F 13/24 181/224 |
| 6,772,859 | B2 * | 8/2004 | D'Antonio | E04B 1/84 181/293 |
| 6,793,037 | B1 | 9/2004 | Babuke et al. | |
| 8,424,637 | B2 * | 4/2013 | Lenz, Jr. | E04B 1/86 181/288 |
| 8,607,925 | B2 * | 12/2013 | Gideonse | E04B 1/8209 181/210 |

OTHER PUBLICATIONS

Fok, Lee et al., "Acoustic metamaterials," MRS Bulletin, Oct. 2008, 33(10):931-934.
Ma, Guancong et al., "Acoustic metasurface with hybrid resonances," Nature Materials, Jun. 2014, 13(9):873-878, Macmillan Publishers Limited.
Mei, Jun et al., "Dark acoustic metamaterials as super absorbers for low-frequency sound," Nature Communications, 2012, 3(756):1-7, Macmillan Publishers Limited.
Yang, Z. et al., "Acoustic metamaterial panels for sound attenuation in the 50-1000 Hz regime," Applied Physics Letters, 2010, 96(4):041906-1-041906-3, American Institute of Physics.
Yang, Z. et al., "Membrane-type acoustic metamaterial with negative dynamic mass," Physical Review Letters, 2008, 101(20):204301-1-204301-4, The American Physical Society.
Jiménez, N. et al., "Ultra-thin metamaterial for perfect and quasi-omnidirectional sound absorption," Applied Physics Letters, 2016, 109(12):121902-1-121902-4, AIP Publishing.
Li, Junfei et al., "A sound absorbing metasurface with coupled resonators," Applied Physics Letters, 2016, 109(9):091908-1-091908-4, AIP Publishing.
Jiang, Xue et al., "Ultra-broadband absorption by acoustic metamaterials," Applied Physics Letters, 2014, 105(24):243505-1-243505-5, AIP Publishing.
Ren, S. W. et al., "Ultrathin multi-slit metamaterial as excellent sound absorber: Influence of micro-structure," Journal of Applied Physics, 2016, 119(1):014901-1-014901-8, American Institute of Physics.
Tang, Yufan et al., "Hybrid acoustic metamaterial as super absorber for broadband low-frequency sound," Scientific Reports, 2017, 7(43340):1-10, Springer Nature.
Christensen, J. et al., "Extraordinary absorption of sound in porous lamella-crystals," Scientific Reports, 2014, 4(4674):1-5.
Larouche, Stéphane et al., "Reconciliation of generalized refraction with diffraction theory," Optics Letters, Jun. 15, 2012, 37(12):2391-2393, Optical Society of America.
Yu, Nanfang et al., "Light Propagation with Phase Discontinuities: Generalized Laws of Reflection and Refraction," Science, Oct. 21, 2011, 334(6054):333-337, American Association for the Advancement of Science, Washington, DC.
Champoux, Yvan et al., "Dynamic tortuosity and bulk modulus in airsaturated porous media," Journal of Applied Physics, Aug. 15, 1991, 70(4):1975-1979, AIP Publishing.
Johnson, David Linton et al., "Theory of dynamic permeability and tortuosity in fluid-saturated porous media," Journal of Fluid Mechanics, 1987, 176: 379-402.
Qiao, Jichao et al., "Mechanical Properties of Porous Stainless Steel Metal Fibre Media," Materials Science Forums, 2009, 618-619:109-112, Trans Tech Publications, Switzerland.
Perrot, Camille et al., "Bottom-up approach for microstructure optimization of sound absorbing materials," Journal of Acoustical Society of America, Aug. 2008, 124(2):940-948, Acoustical Society of America.
Perrot, Camille et al., "Dynamic viscous permeability of an open-cell aluminum foam: Computations versus experiments," Journal of Applied Physics, 2008, 103(2):024909-1-024909-8, American Institute of Physics.
Perrot, Camille et al., "On the dynamic viscous permeability tensor symmetry," Journal of Acoustical Society of America, Oct. 2008, 124(4):EL210-EL217, Acoustical Society of America.
Liu, Shutian et al., "Design optimization of porous fibrous material for maximizing absorption of sounds under set frequency bands," Applied Acoustics, 2014, 76:319-328, Elsevier Ltd.
Bolton, J. S. et al., "Measurement of Normal Incidence Transmission Loss and Other Acoustical Properties of Materials Placed in a Standing Wave Tube," Brüel & Kjær Technical Review, 2007, (1):1-44.
Inoue, Naohisa et al., "Development of a measurement method for oblique-incidence sound absorption coefficient using a thin chamber," Sep. 2016, No. 421, ICA, Buenos Aires.
Fang, Yi et al., "Sound transmission through an acoustic porous metasurface with periodic structures," Applied Physics Letters, Apr. 2017, 110(17):171904-1-171904-5, AIP Publishing.
Kuo, S. M. et al., "Active Noise Control: A Tutorial Review," *Proceedings of the IEEE*, Jun. 1999, 87(6):943-973, IEEE.
Cambonie, T. et al., "Bending a quarter wavelength resonator : Curvature effects on sound absorption properties," *Applied Acoustics*, 2018, 131:87-102, 2017 Elsevier Ltd.
Ingard, U., "On the Theory and Design of Acoustic Resonators* †," *The Journal of the Acoustical Society of America*, Nov. 1953, 25(6):1037-1061, Acoustical Society of America.
Maa, D., "Potential of microperforated panel absorber," *J. Acoust. Soc. Am.*, Nov. 1998, 104(5):2861-2866, Acoustical Society of America.
Yang, C. et al., "Absorption of oblique incidence sound by a finite micro-perforated panel absorber," *J. Acoust. Soc. Am.*, Jan. 2013, 133(1):201-209, Acoustical Society of America.
Guo, J. et al., "Reflected wave manipulation by inhomogeneous impedance via varying-depth acoustic liners," *Journal of Applied Physics*, 2018, 123:1-10, AIP Publishing.
Ma, G. et al., "Acoustic metasurface with hybrid resonances," *Nature Materials*, Sep. 2014, 13:873-878, Macmillan Publishers Limited.
Li, Y. et al., "Acoustic metasurface-based perfect absorber with deep subwavelength thickness," *Applied Physics Letters*, 2016, 108:1-4, AIP Publishing LLC.
Zhang, C. et al., "Three-Dimensional Single-Port Labyrinthine Acoustic Metalmaterial: Perfect Absorption with Large Bandwith and Tunability," *Physical Review Applied*, 2016, 6:1-8, American Physical Society.
Jiménez, N. et al., "Ultra-thin metamaterial for perfect and quasi-omnidirectional sound absorption," *Applied Physics Letters*, 2016, 109:1-4, AIP Publishing.
Li, D. et al., "Enhancing the low frequency sound absorption of a perforated panel by parallel-arranged extended tubes," *Applied Acoustics*, 2016, 102:126-132, 2015 Elsevier Ltd.
Guo, J. et al., "Manipulating reflected acoustic wave via Helmholtz resonators with varying-length extended necks," *Journal of Applied Physics*, 2018, 124:1-8, AIP Publishing.
Huang, S. et al., "Acoustic perfect absorbers via spiral metasurfaces with embedded apertures," *Applied Physics Letters*, 2018, 113:1-5, AIP Publishing.
Huang, S. et al., "Acoustic perfect absorbers via Helmholtz resonators with embedded apertures," *J. Acoust. Soc. Am.*, Jan. 2019, 145(1):254-262, Acoustical Society of America.
Simon, F., "Long Elastic Open Neck Acoustic Resonator for low frequency absorption," *Journal of Sound and Vibration*, 2018, 421:1-16, Elsevier Ltd.
Sakagami, K. et al., "Pilot study on wideband sound absorber obtained by combination of two different microperforated panel (MPP) absorbers," *Acoust. Sci. & Tech.*, 2009, 30(2):154-156, The Acoustical Society of Japan.

(56) References Cited

OTHER PUBLICATIONS

Wang, C. et al., "On the acoustic properties of parallel arrangement of multiple micro-perforated panel absorbers with different cavity depths," *J. Acoust. Soc. Am.*, Jul. 2011, 130(1):208-218, Acoustical Society of America.
Li, J. et al., "A sound absorbing metasurface with coupled resonators," *Applied Physics Letters*, 2016, 109:1-4, AIP Publishing.
Zhao, H. et al., "A slim subwavelength absorber based on coupled microslits," *Applied Acoustics*, 2018, 142:11-17, Elsevier Ltd.
Stinson, M. R., "The propagation of plane sound waves in narrow and wide circular tubes, and generalization to uniform tubes of arbitrary cross-sectional shape," *J. Acoust. Soc. Am.*, Feb. 1991, 89(2):550-558, Acoustical Society of America.
Karal, F. C., "The Analogous Acoustical Impedance for Discontinuities and Constrictions of Circular Cross Section*," *The Journal of the Acoustical Society of America*, Mar. 1953, 25(2):327-334, Acoustical Society of America.
Ryoo, H. et al., "Dual-frequency sound-absorbing metasurface based on visco-thermal effects with frequency dependence," *Journal of Applied Physics*, 2018, 123:1-9, AIP Publishing.
Verdière, K. et al., "Transfer matrix method applied to the parallel assembly of sound absorbing materials," *J. Acoust. Soc. Am.*, Dec. 2013, 134(6):4649-4658, Acoustical Society of America.
"Acoustics—Determination of sound absorption coefficient and impedance in impedance tubes—Part 2: Transfer-function method," *International Standard*, Nov. 15, 1998, First Edition, pp. 1-11, ISO.
Tam, C. K. W. et al., "Microfluid Dynamics and Acoustics of Resonant Liners," *AIAA Journal*, Aug. 2000, 38(8):1331-1339, the American Institute of Aeronautics and Astronautics, Inc.
Tam, C. K. W. et al., "A Numerical and Experimental Investigation of the Dissipation Mechanisms of Resonant Acoustic Liners," *Journal of Sound and Vibration*, 2001, 245(3):545-557, Academic Press.
Romero-García, V. et al., "Use of complex frequency plane to design broadband and sub-wavelength absorbers," *J. Acoust. Soc. Am.*, Jun. 2016, 139(6):3395-3403, Acoustical Society of America.
Li, Y. et al., Acoustic metasurface-based perfect absorber with deep subwavelength thickness, Applied Physics Letters, 2016, 108:1-5, 2016 AIP Publishing LLC.
Zulkifli, R. et al., Noise Control Using Coconut Coir Fiber Sound Absorber with Porous Layer Backing and Perforated Panel, American Journal of Applied Sciences, 2010, 7(2):260-264, 2010 Science Publications.
Hong, Z. et al., A novel composite sound absorber with recycled rubber particles, Journal of Sound and Vibration, 2007, 304:400-406, 2007 Elsevier Ltd.

* cited by examiner

SOUND ABSORBER WITH STAIR-STEPPING STRUCTURE

BACKGROUND

Passive methods of noise control generally involve energy dissipation using sound absorption materials or structures. The main classifications of absorbers are porous materials and resonators including typical Helmholtz resonators, panel or membrane based resonators and perforated panel based resonators [1]. To obtain good sound absorption performance at a single frequency or over a broadband range of frequencies, a combination of different absorbers and a redesign of traditional absorber are usually employed. There arises a special category of acoustic structures that are carefully designed according to different mechanisms to achieve unusual acoustic behaviors, that is so-called acoustic metamaterial [2, 3]. Some acoustic metamaterials for sound absorption are designed based on membrane [4-7], resonators [8, 9] and certain geometric structures, e.g. multi-slits [10, 11] and honeycomb combined with perforated panel [12]. Although most of the resonance-based absorbers can be designed to reduce noise at low frequencies (below 1000 Hz), they are always effective in a relatively narrow frequency range. For the membrane-based absorbers, it is a great challenge to apply them on a large scale and the flimsy material of membrane will be a limiting factor for robust use. In the current studies of porous absorbers, one of the problems is the size of the devices which may reach O(0.5) m so that the good sound absorption can be achieved [13], which brings difficulties for most applications.

BRIEF SUMMARY

Embodiments of the subject invention provide novel and advantageous sound absorbers that comprise a plurality of absorber elements having different thickness and arranged periodically in a first direction, thereby enhancing broadband sound absorption.

In an embodiment, a sound absorber can comprise a unit absorber including a plurality of absorber elements arranged in a first direction, and a wall disposed between the plurality of absorber elements, wherein each of the plurality of absorber elements has a different thickness.

In another embodiment, a sound absorber can comprise a back wall, a plurality of absorber elements disposed on the back wall and arranged periodically in a first direction, and a plurality of frames disposed between the plurality of absorber elements, wherein the plurality of absorber elements make a periodic meta-surface.

In yet another embodiment, a sound absorber can comprise a back wall, a plurality of absorber elements disposed on the back wall and arranged periodically in a first direction and a second direction, and a plurality of frames disposed between the plurality of absorber elements in the first direction and the second direction, wherein each of the plurality of absorber elements has a thickness such that each upper surface of the plurality of absorber elements makes a meta-surface having a first period in the first direction and a second period in the second direction.

BRIEF DESCRIPTION OF DRAWINGS

FIG. 1(*b*) shows relationship between a reflected angle and an incident angle when a ratio ($\lambda_i$/d) of a wavelength of incident wave with respect to a period of a structure is larger than 2.

FIG. 4(*b*) shows a cross-sectional view taken along line A-A in FIG. 4(*a*), of a sound absorber according to an embodiment of the subject invention.

FIG. 6(*b*) shows a cross-sectional view taken along line B-B in FIG. 6(*a*), of a sound absorber according to an embodiment of the subject invention.

FIG. 8(*b*) shows a cross-sectional view taken along line C-C in FIG. 8(*a*), of a sound absorber according to an embodiment of the subject invention.

FIG. 9(*b*) shows a real part and an imaginary part of the characteristic wavenumber $k_c$ in a simulation and an experiment.

FIG. 11(*b*) shows a simulated meta-surface with a period length of 0.12 m at a 0° incidence.

FIG. 11(*c*) shows a simulated meta-surface with a period length of 0.08 m at a −45° incidence.

FIG. 12(*b*) shows an experimental result of a meta-surface with a period length of 0.12 m at a −45° incidence.

FIG. 12(*c*) shows an experimental result of a meta-surface with a period length of 0.08 m at a −45° incidence.

FIG. 13(*b*) shows a sound absorption coefficient with respect to a frequency at normal incidence.

FIG. 15(*b*) shows a reflected sound pressure field including a surface wave near the reflected interfaces at a −45° incidence.

FIG. 16(*b*) shows a reflected sound pressure field when including periodic boundaries on boundaries on the lateral sides at a simulated meta-surface with a period length of 0.08 m at a −45° incidence.

DETAILED DESCRIPTION

Embodiments of the subject invention provide novel and advantageous sound absorbers that comprise a plurality of absorber elements having different thickness and arranged periodically in a first direction, thereby enhancing broadband sound absorption.

Considering a periodic structure backed with a rigid wall and impinged by a sound wave, the reflected waves can be predicted by the diffraction theory [14] expressed as an Equation 1.

$$n_i \sin(\theta_r) - n_i \sin(\theta_i) = m\frac{\lambda_i}{2\pi}\frac{d\Phi}{dx}, \tag{1}$$

where $n_i$ is the refraction index of the incidence or reflection region, and it equals to 1 when the structure is placed in air. $\theta_r$ and $\theta_i$ are the reflected and incident angles, respectively. The integer m is the order of the diffraction peak. $\lambda_i$ is the wavelength of incident wave. $d\Phi/dx$ is the phase gradient along the reflected surface of the structure which can be expressed as $|2\pi/d|$ for a linear phase profile at the surface, where d is the period length. There will be more than one reflected wave corresponding to different diffracted orders m. It can be seen that both the incident angle $\theta_i$ and the ratio $\lambda_i/d$ exert the deciding influences on the reflected behaviors. Provided that the ratio $\lambda_i/d$ is set suitably, the number and the directions of reflected waves can be controlled at a fixed incident angle. The regularities between the reflected and incident angles under various ratios $\lambda_i/d$ are shown in FIGS. 1(*a*) and 1(*b*).

Figure 1A:
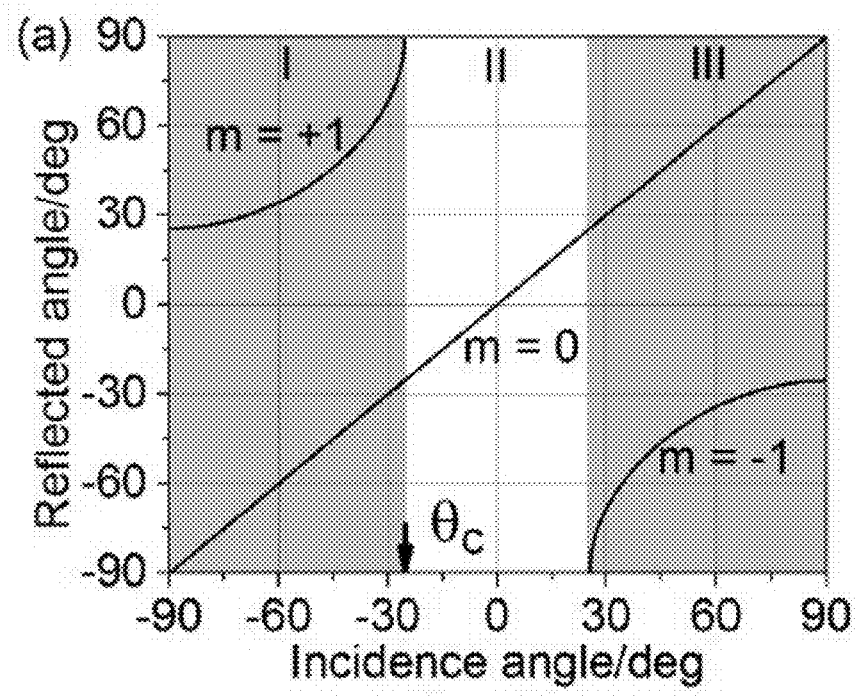
FIG. 1(*a*) shows relationship between a reflected angle and an incident angle when a ratio ($\lambda_i$/d) of a wavelength of incident wave with respect to a period of a structure is in a range of 1 to 2.
Figure 1B:
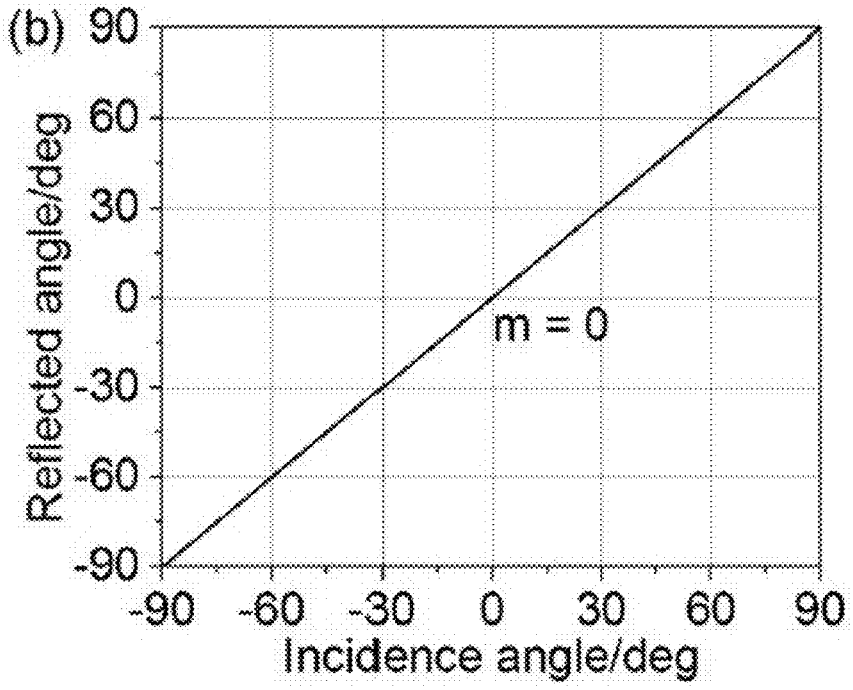

FIG. 1(*a*) shows relationship between a reflected angle and an incident angle when a ratio ($\lambda_i/d$) of a wavelength of incident wave with respect to a period of a structure is in a range of 1 to 2, and FIG. 1(*b*) shows relationship between a reflected angle and an incident angle when a ratio ($\lambda_i/d$) of a wavelength of incident wave with respect to a period of a structure is larger than 2. Referring to FIGS. 1(*a*) and 1(*b*), with the change of the ratio $\lambda_i/d$, the reflected phenomena including the number and angles of the reflected waves vary. For the case with $1<\lambda_i/d=1.429<2$ (d=0.12 m at 2,000 Hz) of FIG. 1(*a*), there are two reflected waves at a certain incident angle in the regions I and III which are labeled in FIG. 1(*a*). There is only one wave with m=0 in the region II, that corresponds to the specular reflection. For the case with $\lambda_i/d=2.144>2$ (d=0.08 m at 2,000 Hz) of FIG. 1(*b*), only the specular reflection exists at all the incident angles, as shown in FIG. 1(*b*).

The $+1^{st}$ order diffracted wave carries the most energy for a meta-surface with a linear phase profile and this wave can be described by the generalized Snell's law [15]. The generalized Snell's law can only account for the case with m=+1 in the diffraction theory. For this wave, there is a critical incidence angle $\theta_c$ labeled in FIG. 1(*a*), which can be calculated by an Equation 2.

$$\theta_c = \arcsin\left(\pm 1 - \frac{\lambda_i}{2\pi}\frac{d\Phi}{dx}\right). \tag{2}$$

When the incident angle is larger than the critical angle, the $+1^{st}$ order diffracted wave converts into a surface wave that propagates along the reflected surface. The conversion from the propagation wave to a surface wave means that the $+1^{st}$ order diffracted wave carrying the most acoustic energy cannot radiate into the acoustic far field. Thus, within the range of incident angle $\theta_i \geq \theta_c$, noise radiation can be reduced effectively. Furthermore, it can be noticed that the critical incidence angle will be smaller than −90° when the period length d is smaller than a half of wavelength. At this case, except for the specular reflected wave with m=0, all the waves will not radiate into the acoustic far field at omni-directional incidence, as shown in FIG. 1(*b*). Thus, the sound absorption performance is not limited by the critical angle anymore.

Figure 2:
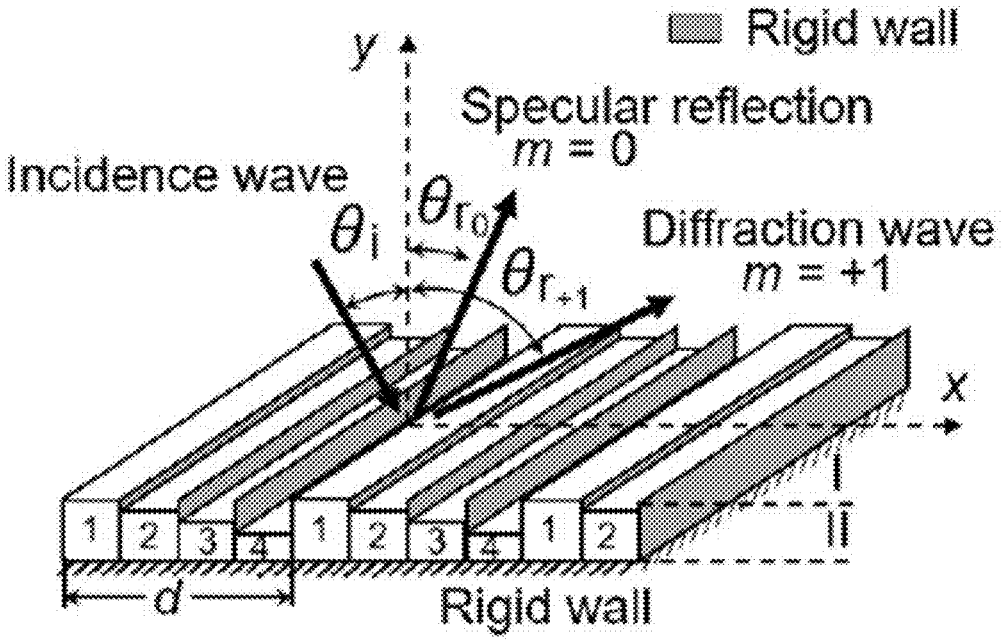
FIG. 2 shows a schematic view of a sound absorber according to an embodiment of the subject invention.

FIG. 2 shows a schematic view of a sound absorber according to an embodiment of the subject invention. Referring to FIGS. 1-2, the sound absorber comprises a periodic meta-surface including four slits in one period filled with one kind of porous material with various thicknesses to generate a desired phase gradient $d\Phi/dx$ on the reflected surface. The different thicknesses are carefully designed individually to form a linear phase gradient on the upper surface of the whole meta-surface (the upper surface of the region II labeled in FIG. 2).

To define a porous material with a certain thickness as an element in the proposed meta-surface, suitable parameters should be specified to evaluate its acoustic characteristics. Here, each element is assumed to be formed by a porous material within a rigid frame. It has been shown that the so-called Johnson-Champoux-Allard model (JCA model) [16-17] can predict accurately the broadband acoustic characteristics of the rigid porous materials and the model can be expressed as the following Equations 3 and 4:

$$K_e = \frac{\gamma P_0/\phi}{\gamma - \dfrac{\gamma - 1}{1 + \dfrac{8\eta}{j\Lambda'^2 B^2 \omega \rho_0}\left(1 + j\rho_0 \dfrac{\omega B^2 \Lambda'^2}{16\eta}\right)^{\frac{1}{2}}}}, \tag{3}$$

$$\rho_e = \frac{\alpha_\infty \rho_0}{\phi}\left[1 + \frac{\sigma\phi}{j\omega\rho_0\alpha_\infty}\left(1 + \frac{4j\alpha_\infty^2 \eta \rho_0 \omega}{\sigma^2 \Lambda^2 \phi^2}\right)^{\frac{1}{2}}\right], \tag{4}$$

where $K_e$ and $\rho_e$ are the effective bulk modulus and the effective density, respectively. $\gamma$ is the ratio of specific heat. $P_0$, $\rho_0$ and $\eta$ are the pressure, density, and viscosity of air, respectively. $B^2$ is the Plank constant of air. $\omega$ is the angular frequency. The five parameters relating with acoustic performance in the JCA model are: porosity$\phi$(−), flow resistivity $\sigma$(Nm−4s), tortuosity $\alpha_\infty$(−), viscous characteristic length $\Lambda$(m) and thermal characteristic length $\Lambda'$(m). The desired phase shift can be obtained by a combination of these five parameters. A metal-based fibrous material is selected to realize the design, which possesses good mechanical properties such as high compressive strength and excellent energy absorption capacity [18]. Its fiber diameter D and porosity $\phi$ can be customized. Once these two parameters are decided, the five parameters in the JCA model can be obtained through a bottom-up approach [19-22] and they decide the phase response of each element directly. The analytical model for building up the relationship between the acoustic characteristics of the porous material and the phase response is given later.

The metal-based fibrous material with a fiber diameter of 12 μm and a porosity of 0.91 is selected to realize the meta-surface of embodiment of the subject invention. Using a bottom-up approach, five parameters can be obtained: $\phi$=0.91, $\sigma$=184269.0875 $Nm^{-4}s$, $\alpha_\infty$=1.045, $\Lambda$=3.30E−05 m and $\Lambda'$=6.07E 05 m. Thus, the effective bulk modulus $K_e$ and density $\rho_e$ can be calculated by the above Equations 3 and 4.

Figure 3:
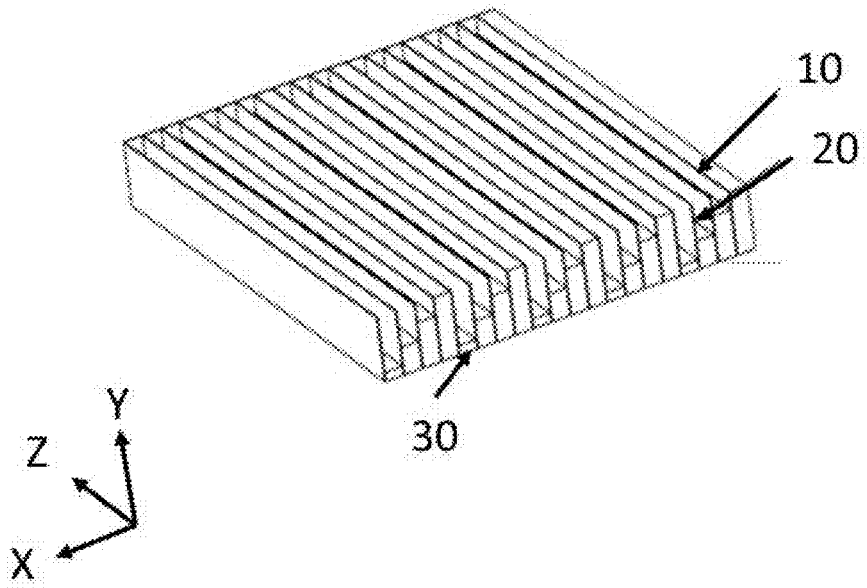
FIG. 3 shows a sound absorber according to an embodiment of the subject invention.
Figure 4A:
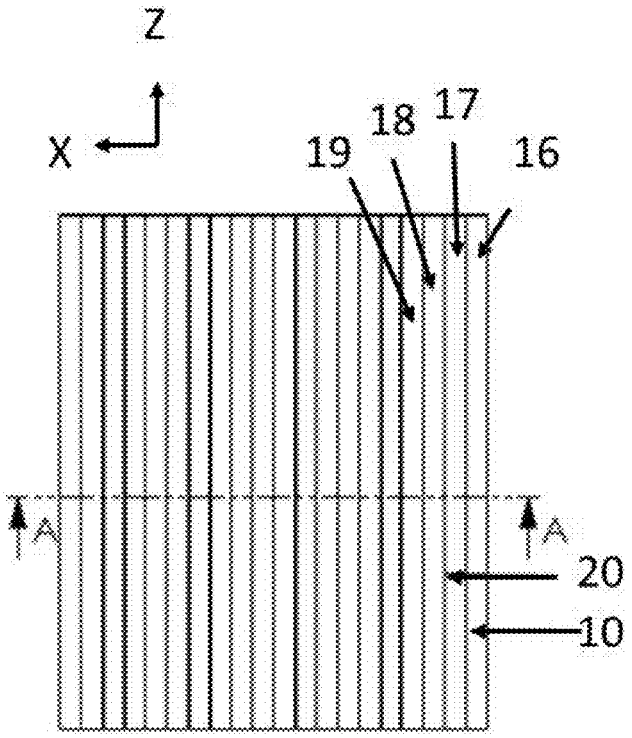
FIG. 4(*a*) shows atop view of a sound absorber of FIG. 3.
Figure 4B:
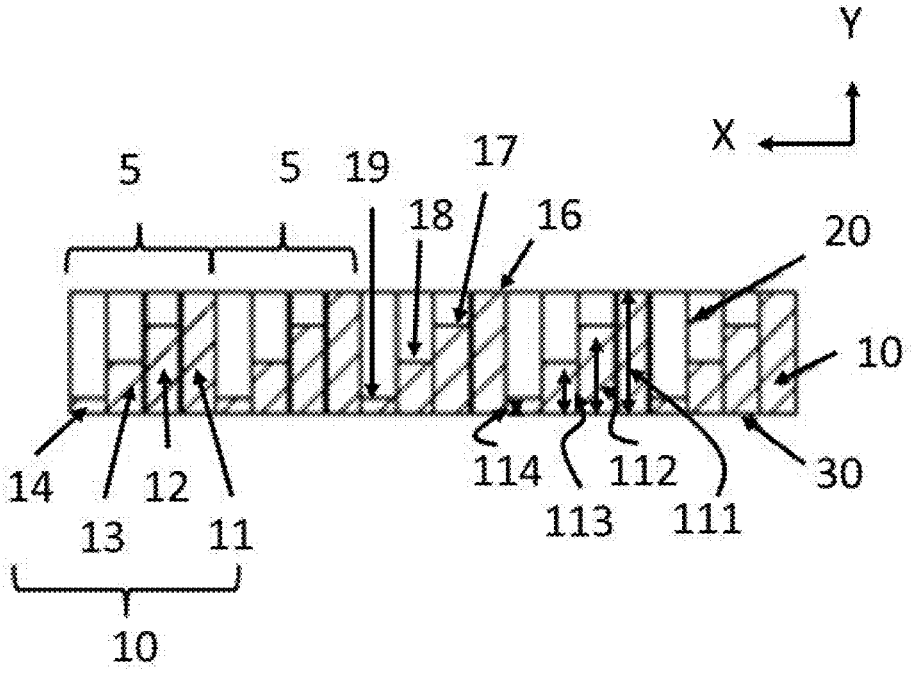

FIG. 3 shows a sound absorber according to an embodiment of the subject invention. FIG. 4(*a*) shows a top view of a sound absorber of FIG. 3, and FIG. 4(*b*) shows a cross-sectional view taken along line A-A in FIG. 4(*a*), of a sound absorber according to an embodiment of the subject invention. Referring to FIGS. 3, 4(*a*), and 4(*b*), a sound absorber comprises a unit absorber 5 including a plurality of absorber elements 10 arranged in a first direction X, and a wall 20 disposed between the plurality of absorber elements 10. The unit absorber 5 is repeatedly and periodically arranged in the first direction X. A period of the unit absorber 5 is smaller than a half wavelength of an incident wave. For example, the period of the unit absorber 5 is selected to be smaller than 0.08575 m with respect to the incident wave having a frequency of 2000 Hz. Each of the unit absorber 5 comprises a number of elements. For example, in the embodiment depicted there are four elements in one period with a first element 11, a second element 12, a third element 13, and a fourth element 14 of the plurality of absorber elements 10, wherein each of the first to fourth elements has different thickness. A first thickness 111 of the first element 11, a second thickness 112 of the second element 12, a third thickness 113 of the third element 13, and a fourth thickness 114 of the fourth element 14 are different such that each magnitude of the thicknesses changes to generate a linear phase gradient at the reflected interface (or reflected surface) of a whole structure of the sound absorber. Thus, a thickness of an upper surface of a whole meta-surface of the unit absorber 5 is configured to be the same as the highest thickness of the plurality of absorber elements 10. For example, the first thickness 111 is 0.07 m, the second thickness 112 is 0.05 m, the third thickness 113 is 0.03 m, the fourth thickness 114 is 0.01 m, and a thickness of a whole meta-surface (or a thickness of the reflected surface of the whole structure) is 0.07 m. That is, a first upper surface 16 of the first element 11, a second upper surface 17 of the second element 12, a third upper surface 18 of the third element 13, and a fourth upper surface 19 of the fourth element 14 are placed in different position such that the first to fourth upper surfaces make a stair-stepping meta-surface.

Each of the first to fourth elements extends in a second direction Z, thereby each of first to fourth upper surfaces has a rectangular shape. The first to fourth elements have the first to fourth thicknesses extending in a third direction Y. The wall 20 is disposed between adjacent two elements as a rigid frame and has a same thickness as the first thickness 111. Each element is disposed in each slit that is made of the wall 20.

The sound absorber further includes a back wall 30 disposed on a bottom surface of the unit absorber 5. The plurality of absorber elements 10 are made of a porous material that includes a plastic foam, a metal foam, a granular porous material, and a glass fibrous material. In particular, the porous materials can be a metal based fibrous material such as FeCrAl fibrous material and the metal based fibrous material can have a fiber diameter of 12 μm and a porosity of 0.91. The wall 20 is made of a thin and rigid plate, and can be made of a metal, a plexiglass, or a plastic. For example, the wall 20 is made of a rigid medium including metal such as a stainless steel plate and plastic, having a thickness of 0.1 mm. The back wall 30 is made of a rigid wall.

Figure 5:
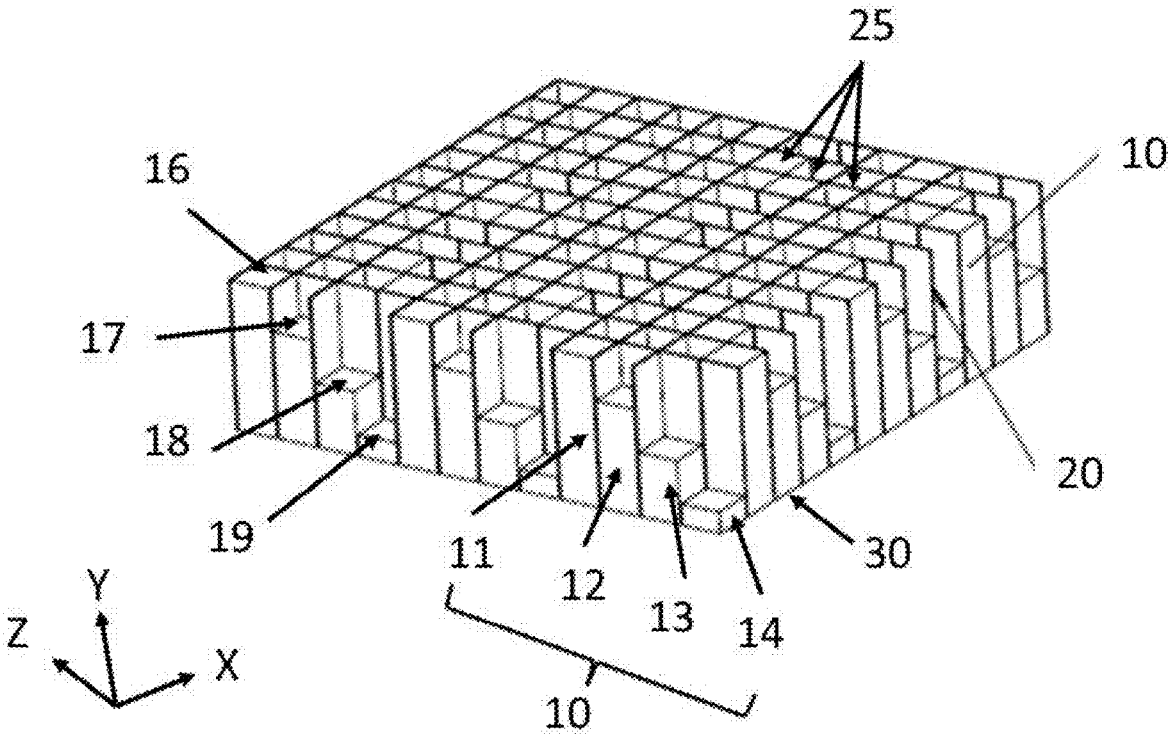
FIG. 5 shows a sound absorber according to an embodiment of the subject invention.
Figure 6A:
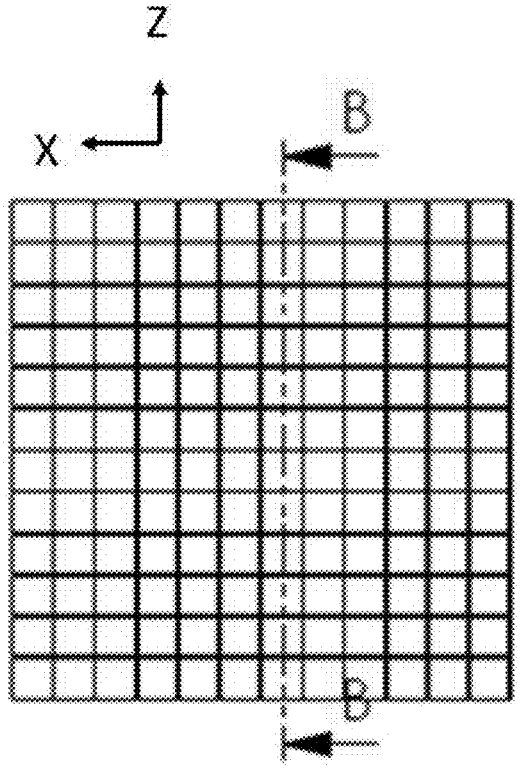
FIG. 6(*a*) shows a top view of a sound absorber of FIG. 5.
Figure 6B:
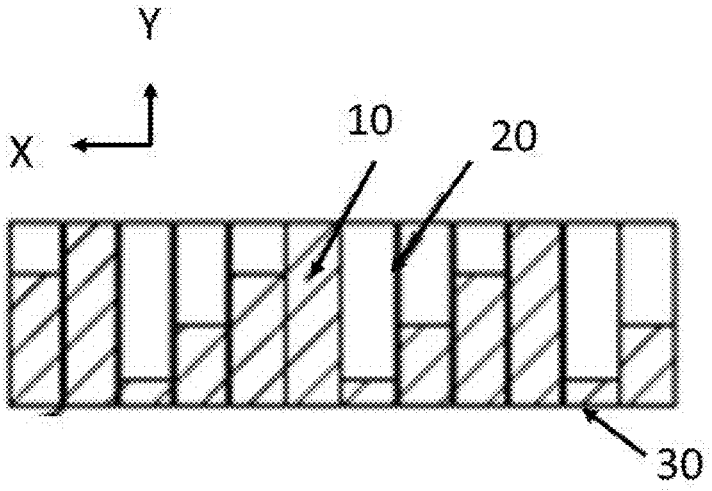

FIG. 5 shows a sound absorber according to an embodiment of the subject invention. FIG. 6(*a*) shows a top view of a sound absorber of FIG. 5, and FIG. 6(*b*) shows a cross-sectional view taken along line B-B in FIG. 6(*a*), of a sound absorber according to an embodiment of the subject invention. Referring to FIGS. 5, 6(*a*), and 6(*b*), a sound absorber includes the back wall 30, the plurality of absorber elements 10 disposed on the back wall, and the plurality of walls 20 disposed between the plurality of absorber elements 10.

The plurality of absorber elements 10 are arranged periodically in the first direction X and in the second direction Z as well. That is, the first element 11, the second element 12, the third element 13, and the fourth element 14 are periodically arranged in the first direction X and simultaneously arranged in the second direction Z while making a periodic arrangement. A first period in the first direction X can be the same as a second period in the second direction Z. There are a number of elements with various thicknesses in one period. For example, there are four elements in one period in the first and second directions. The first element 11, the second element 12, the third element 13, and the fourth element 14 have different thicknesses, respectively, such that a cross-sectional view shows a stair-stepping structure. The first upper surface 16, the second upper surface 17, the third upper surface 18, and the fourth upper surface 19 make a two-dimensional meta-surface defined in the first direction X and the second direction Z. Each of the first to fourth upper surfaces can have a square shape.

The plurality of walls 20 are disposed between the plurality of absorber elements 10 in the first direction X and the second direction Z, thereby the plurality of walls 20 functioning as a plurality of frames provide a plurality of spaces 25 in which the plurality of absorber elements 10 are placed. A thickness of the wall 20 is the same as that of the first element 11.

Figure 7:
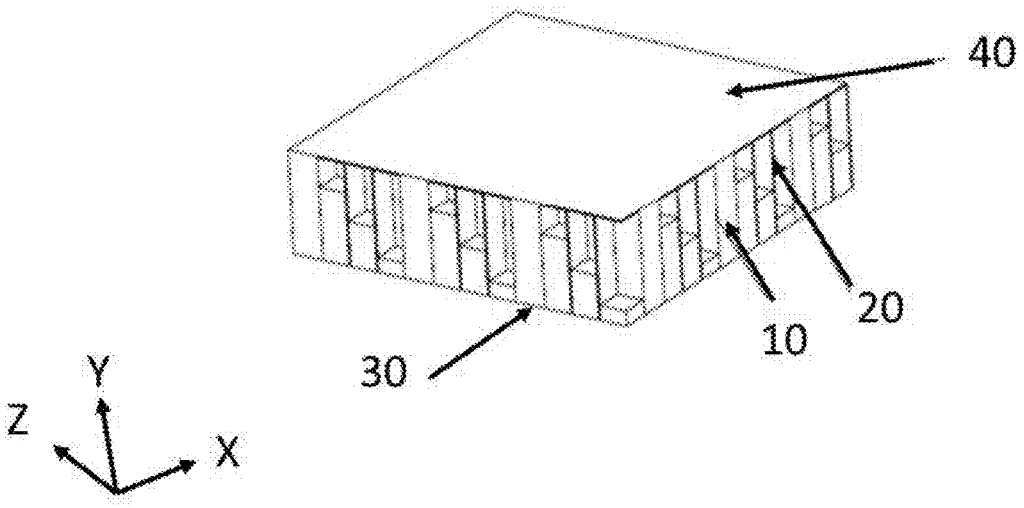
FIG. 7 shows a sound absorber according to an embodiment of the subject invention.
Figure 8A:
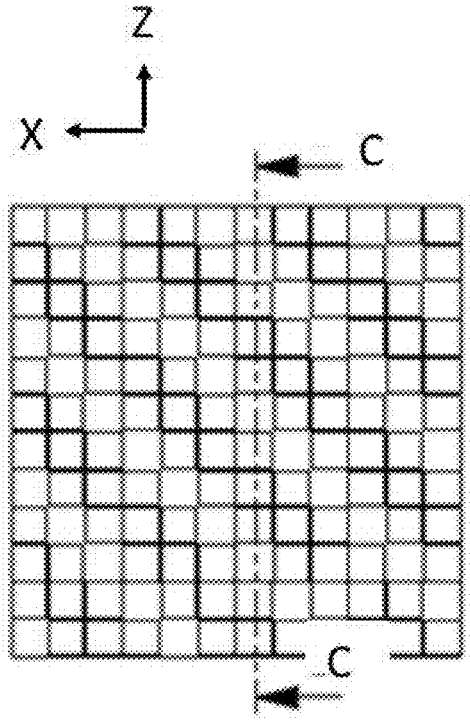
FIG. 8(*a*) shows a top view of a sound absorber of FIG. 7.
Figure 8B:
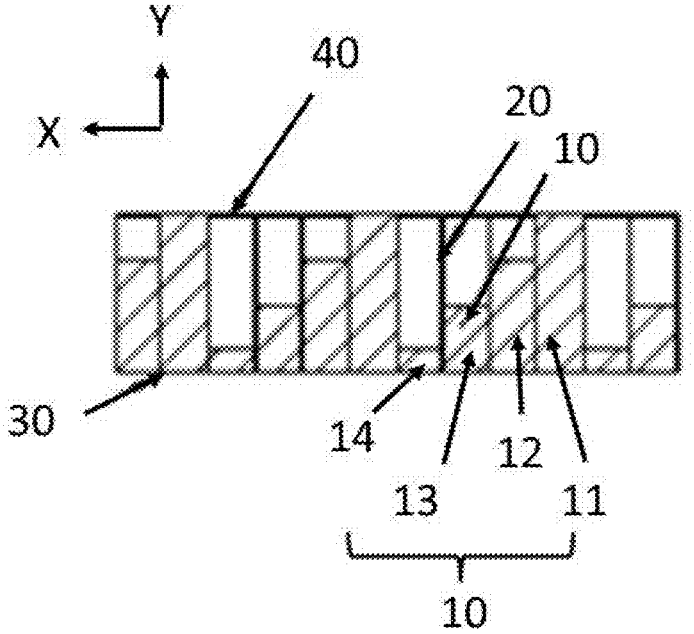

FIG. 7 shows a sound absorber according to an embodiment of the subject invention. FIG. 8(*a*) shows a top view of a sound absorber of FIG. 7, and FIG. 8(*b*) shows a cross-sectional view taken along line C-C in FIG. 8(*a*), of a sound absorber according to an embodiment of the subject invention. Referring to FIGS. 7, 8(*a*), and 8(*b*), a sound absorber includes the back wall 30, the plurality of absorber elements 10 disposed on the back wall 30, the plurality of walls 20 disposed between the plurality of absorber elements 10, and a cover layer 40 disposed on the plurality of absorber elements 10 and the plurality of walls 20. The cover layer 40 is in direct physical contact with the first element 11 of the plurality of absorber elements 10 and the plurality of walls 20. Instead, the cover layer 40 is spaced apart from the second element, 12, the third element 13, and the fourth element 14 of the plurality of absorber elements 10.

The subject invention includes, but is not limited to, the following exemplified embodiments.

Embodiment 1

A sound absorber, comprising:

a unit absorber including a plurality of absorber elements arranged in a first direction; and a wall disposed between the plurality of absorber elements, wherein each of the plurality of absorber elements has a different thickness.

Embodiment 2

The sound absorber according to embodiment 1, further comprising a back wall disposed on a bottom surface of the unit absorber.

Embodiment 3

The sound absorber according to any of embodiments 1-2, wherein the plurality of absorber elements are made of a porous material.

Embodiment 4

The sound absorber according to embodiment 3, wherein the porous material is a metal based fibrous material.

Embodiment 5

The sound absorber according to any of embodiments 1-4, wherein the wall is a stainless steel plate.

Embodiment 6

The sound absorber according to any of embodiments 1-5, wherein the unit absorber is periodically arranged in the first direction with a period length.

Embodiment 7

The sound absorber according to any of embodiments 1-6, wherein each thickness of the plurality of absorber elements is different from the others to form a linear phase gradient on an upper surface of a whole structure of the sound absorber.

Embodiment 8

The sound absorber according to embodiment 7, wherein thicknesses of adjacent absorber elements of the plurality of absorber elements are configured to generate a phase shift of $2\pi/n$, where n is the number in one period (e.g., if there are four elements in the one period, the phase shift between two adjacent elements is $\pi/2$).

Embodiment 9

A sound absorber, comprising:

a back wall:

a plurality of absorber elements disposed on the back wall and arranged periodically in a first direction; and a plurality of frames disposed between the plurality of absorber elements, wherein the plurality of absorber elements make a periodic meta-surface.

Embodiment 10

The sound absorber according to embodiment 9, wherein a thickness of each of the plurality of absorber elements changes to generate a linear phase gradient at a reflected interface of a whole structure of the sound absorber.

Embodiment 11

The sound absorber according to any of embodiments 9-10, wherein the plurality of absorber elements are made of a porous material.

Embodiment 12

The sound absorber according to embodiment 11, wherein the plurality of absorber elements include a first element, a second element, a third element, a fourth element, and a $n^{th}$ element when there are n elements in one period.

Embodiment 13

The sound absorber according to embodiment 12, wherein each of the first, second, third, fourth, and $n^{th}$ elements has a first thickness, a second thickness, a third thickness, a fourth thickness, and a $n^{th}$ thickness, respectively, and two adjacent thicknesses are different from each other to generate a $2\pi/n$ phase shift between the two adjacent elements (e.g., when there are four elements, the phase shift between two adjacent elements is $\pi/2$).

Embodiment 14

The sound absorber according to embodiment 13, wherein thicknesses are designed to form the linear phase gradient at an interested frequency (e.g., with respect to 2,000 Hz, the first thickness is 0.07 m, the second thickness is 0.05 m, the third thickness is 0.03 m, and the fourth thickness is 0.01 m).

Embodiment 15

The sound absorber according to any of embodiments 9-14, wherein a period length of the plurality of absorber elements is configured to be smaller than a half wavelength of an incident wave.

Embodiment 16

The sound absorber according to any of embodiments 11-15, wherein the porous material is at least one of a metal based fibrous material, a plastic foam, a metal foam, a granular porous material, and a glass fibrous material.

Embodiment 17

The sound absorber according to embodiment 16, wherein a porosity of the porous material is 0.91 and a fiber diameter of the porous material is 12 pin.

Embodiment 18

The sound absorber according to any of embodiments 9-17, further comprising a cover layer disposed on the plurality of absorber elements.

Embodiment 19

A sound absorber, comprising:

a back wall;

a plurality of absorber elements disposed on the back wall and arranged periodically in a first direction and a second direction; and a plurality of frames disposed between the plurality of absorber elements in the first direction and the second direction, wherein each of the plurality of absorber elements has a thickness such that each upper surface of the plurality of absorber elements makes a meta-surface having a first period in the first direction and a second period in the second direction.

Embodiment 20

The sound absorber according to embodiment 19, wherein the plurality of absorber elements are made of a porous material.

Embodiment 21

The sound absorber according to any of embodiments 19-20, wherein the plurality of frames are made of at least one of a metal, a plexiglass, and a plastic.

Embodiment 22

The sound absorber according to any of embodiments 19-21, wherein the first period is the same as the second period.

Embodiment 23

The sound absorber according to any of embodiments 19-22, wherein each upper surface of the plurality of absorber elements has a square shape.

Embodiment 24

The sound absorber according to any of embodiments 19-23, further comprising an acoustically transparent cover layer disposed on the plurality of absorber elements.

Embodiment 31

A stair-stepping sound-absorbing structure, for applying on a wall, ceiling, door, or as a sound-barrier on a road, comprising:

a one-dimensional laid panel capable of attenuating sound, wherein the one-dimensional laid panel comprises:

a layer of porous material with a stair-stepping configuration, the layer of the porous material comprising a series of periodic structures in one direction, and having a number of separated elements in one period.

Embodiment 32

A stair-stepping sound-absorbing structure, for applying on a wall, ceiling, door, or as a sound-barrier on a road, comprising:

a two-dimensional laid panel capable of attenuating sound, wherein the two-dimensional laid panel comprises:

a layer of porous material with a stair-stepping configuration, the layer of the porous material comprising a series of periodic structures in two directions, and having a number of separated elements in one period.

Embodiment 33

A stair-stepping sound-absorbing structure, for applying on a wall, ceiling, door, sound-barrier on a road or other situations where a smooth upper surface is desired including flow presence, comprising:

a one-dimensional or two dimensional laid panel capable of attenuating sound, wherein the panel comprises:

a layer of sound transparent material or thin material with high transmission, such as Kevlar cloth; and a layer of porous material with a stair-stepping configuration, the layer of the porous material comprising a series of periodic structures in one or two directions, and having a number of separated elements in one period.

Embodiment 34

The stair-stepping sound-absorbing structure of any of embodiments 31, 32, and 33, wherein the porous material comprises a metal based fibrous material. (e.g., the metal based fibrous material can be a FeCrAl fibrous material with porosity of 0.91 and fiber diameter of 12 mm. The same material with other parameters and the other kinds of porous material including plastic foam, glass fibrous material, etc. can also work.)

Embodiment 35

The stair-stepping sound-absorbing structure of any of embodiments 31, 32, and 33, wherein the four elements in one period have the thicknesses of 7 cm, 5 cm, 3 cm and 1 cm individually. (The thicknesses of elements depend on the interested frequency and selected porous material. They can be flexible but the design principle is the completely same. The number of elements in one period is set as four, but it can also vary as desired.)

Embodiment 36

The stair-stepping sound-absorbing structure of any of embodiments 31, 32, and 33, wherein the length of one period is 0.08 m. (Two meta-surfaces with periodic lengths of 0.12 m and 0.08 m are available. The one with the periodic length of 0.12 m is considered for verifying the acoustic behaviors of wave manipulation. The one with the periodic length of 0.08 m is considered for good sound absorption. It can work as long as the length is smaller than a half wavelength.)

Embodiment 37

The stair-stepping sound-absorbing structure of any of embodiments 31, 32, and 33, wherein the four individual elements in one period are separated by thin and rigid plates, which also act as supports of whole structure. (Stainless steel plates with thickness of 0.1 mm can be used. Other dense materials including metal, plexiglass, and plastic can work similarly.)

A greater understanding of the present invention and its many advantages may be had from the following example, given by way illustration. The following example shows some of the methods, applications, embodiments and variants of the present invention. They are, of course, not to be considered as limiting the invention. Numerous changes and modifications can be made with respect to the invention.

EXAMPLE

Figure 9A:
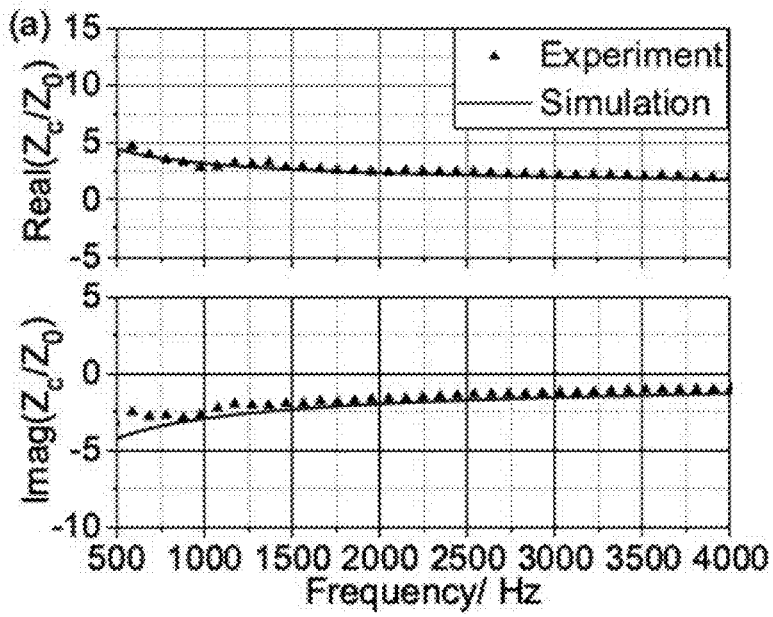
FIG. 9(*a*) shows a real part and an imaginary part of the characteristic impedance $Z_c$ normalized by the air impedance $Z_0$ in a simulation and an experiment.
Figure 9B:
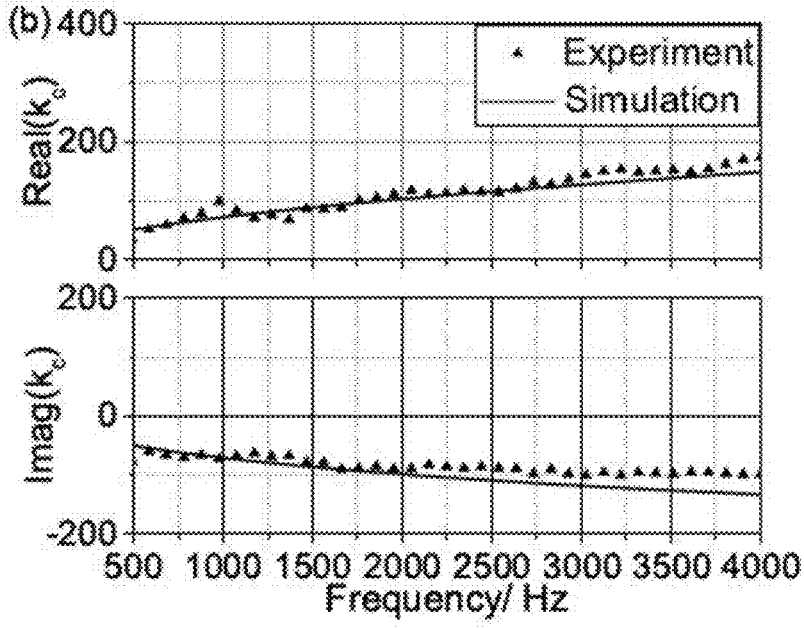

FIG. 9(*a*) shows a real part and an imaginary part of the characteristic impedance $Z_c$ normalized by the air impedance $Z_0$ in a simulation and an experiment, and FIG. 9(*b*) shows a real part and an imaginary part of the characteristic wavenumber $k_c$ in a simulation and an experiment. The realistic material sample is tested in a Brüel Kjær Type 4206 Four microphone Impedance Measurement Tube [23] to validate the acoustic properties. In the test, the characteristic impedance $Z_c$ and the wavenumber $k_c$ of material are obtained. These two parameters are equivalent to the effective bulk modulus $K_e$ and the density $\rho_e$ in the JCA model and they can be calculated by $Z_c=\rho_e c_e=\sqrt{(K_e\rho_e)}$ and $kc=\omega/\rho_e$, where $c_e=\sqrt{(K_e\rho_e)}$ is the effective speed of sound. The $Z_c$ and $k_c$ in simulations are obtained by the bottom-up method.

FIGS. 9(*a*) and 9(*b*) show the comparisons of the real and imaginary parts of $Z_c$ normalized by the air impedance $Z_0$ and $k_c$ between calculations and experimental results. Good agreement can be obtained over a range of broadband frequencies, where the interested frequency of 2,000 Hz is included. It means that the parameters, which describe the acoustic characteristics of porous material in the simulations, can accurately predict acoustic behaviors of realistic porous samples.

Figure 10:
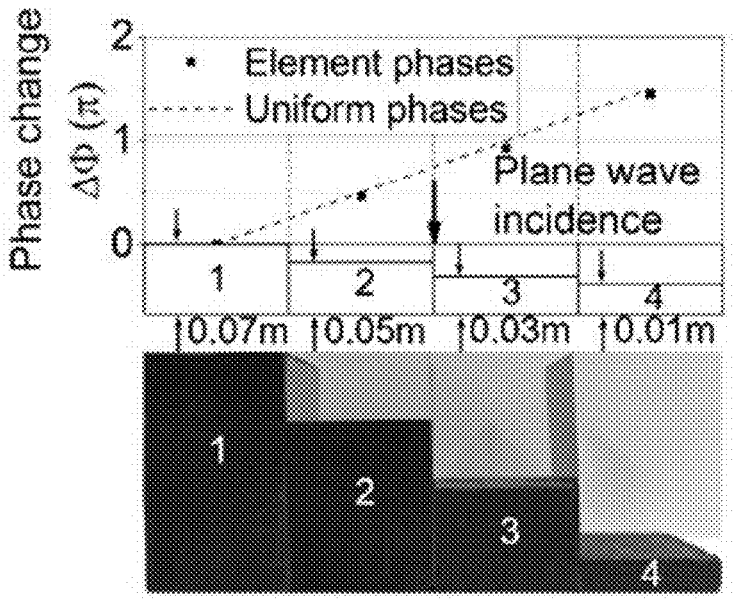
FIG. 10 shows the relationship between thickness and phase response of a sound absorber according to an embodiment of the subject invention.

FIG. 10 shows the relationship between thickness and phase response of a sound absorber according to an embodiment of the subject invention. Based on the reliable material selection of the sound absorber, the phase information is extracted from the complex sound pressure of the reflected wave of each individual and uniform element, excited normally by a plane wave at 2,000 Hz. By adjusting the thicknesses of material, the expected phase responses can be obtained. The selected thicknesses of four elements are 0.07 m, 0.05 m, 0.03 m and 0.01 m, and they generate a $\pi/2$ phase shift between each two adjacent elements, as shown in FIG. 10. The analytical model for calculating the complex sound pressures of reflected waves is given later.

Numerical Simulations of the Reflected Behaviors

Figure 11A:
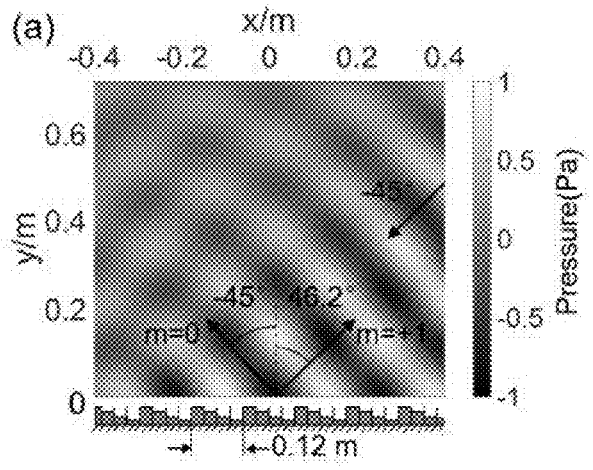
FIG. 11(*a*) shows a simulated meta-surface with a period length of 0.12 m at a −45° incidence.
Figure 11B:
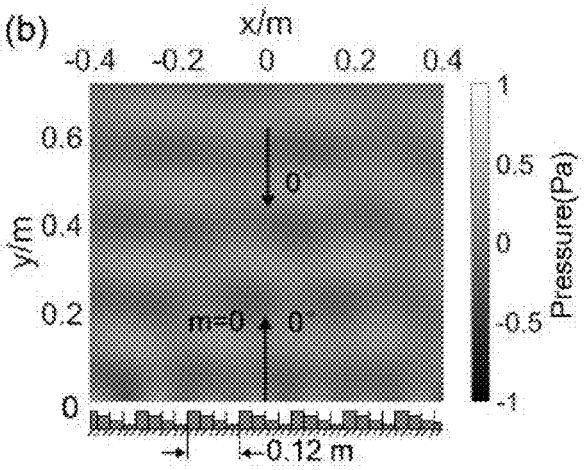
Figure 11C:
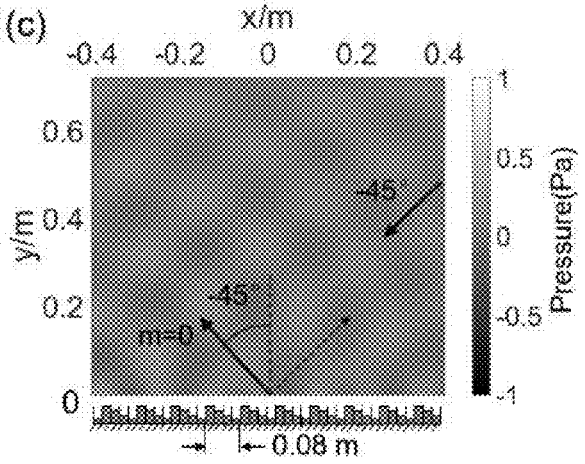

To validate the reflected behaviors predicted by the diffraction theory, especially the disappearances of high-order waves which play key roles for the noise reduction, two meta-surfaces with period lengths of 0.12 m ($\lambda_i$/d=1.429 at 2,000 Hz) and 0.08 m ($\lambda_i$/d=2.144 at 2,000 Hz) corresponding to the cases shown in FIGS. 1(*a*) and (*b*), respectively, are considered with the plane wave incidence at 2,000 Hz. For the meta-surface with the period length of 0.12 m, the critical incidence angle $\theta_c$ of the $+1^{st}$ order diffracted wave is −25°, given by the Equation 2. To validate the disappearance of $+1^{st}$ order diffracted wave, two cases with the incident angles of −45° and 0° located at both sides of the critical value are simulated. Furthermore, at a −45° incidence, the other meta-surface with the period length of 0.08 m ($\lambda_i$/d=2.144 at 2,000 Hz) is simulated to verify that only the specular reflection exists when $\lambda_i$/d>2. FIGS. 11(*a*)-(*c*) show the simulated results of the three cases mentioned above. In particular, FIG. 11(*a*) shows a simulated meta-surface with a period length of 0.12 in at a −45° incidence, FIG. 11(*b*) shows a simulated meta-surface with a period length of 0.12 m at a 0° incidence, and FIG. 11(*c*) shows a simulated meta-surface with a period length of 0.08 m at a −45° incidence.

According to the diffraction theory expressed as the Equation 1, the number and directions of the reflected waves can be predicted. For the meta-surface with the period length of 0.12 m ($\lambda_i$/d=1.429 at 2,000 Hz), there are two reflected waves when the incident angle is smaller than the critical angle of −25°, corresponding to the region I in FIG. 1(*a*). Thus, at a −45° incidence, there are two reflected waves whose propagation directions can be predicted by the diffraction theory (see, e.g., Equation 1) and the reflected angles are labeled in FIG. 11(*a*). The simulated results match well with the predictions. One wave is the specular reflection with m=0 whose reflected angle has the same value with that of the incident wave. The reflected angle of the other diffracted wave with $+1^{st}$ order is 46.2°. For the case with the normal incidence shown in FIG. 11(*b*), the incident angle is larger than the critical one −25° and the total internal reflection appears with the $+1^{st}$ order diffracted wave. The reflected wave converts into a surface wave and will not radiate into the acoustic far field. Thus, only the specular reflection should exist. More details about the surface waves near the meta-surface can be found later. Here, the sound pressure distribution in the acoustic far field, which is important for the noise control, is the primary concern in the simulations and also the laboratory tests which will be introduced next. For the meta-surface with the period length of 0.08 m ($\lambda_i$/d=2.144 at 2,000 Hz), the critical angle is smaller than −90°, which means only the specular reflection exists at the omni-directional incidence, as shown in FIG. 1(*b*). Here, the case with −45° incidence is simulated as an example and the result is shown in FIG. 11(*c*) with a solid arrow indicating the propagation direction of the specular reflection. However, there exists the other wave whose direction is indicated by a dashed arrow. It can be explained that the simulated sound pressure field in this case is affected by the Perfect Matched Later (PML) boundaries on the lateral sides of computational domains, so the extra wave is generated. In fact, this spurious wave will not appear if the computational domain is infinite. It can be realized through replacing PMLs by periodic boundaries. The details about the sound pressure pattern of the case with the periodic boundaries can be found later.

Measurements of the Reflected Behaviors

The simulated results are validated by the laboratory tests. The whole meta-surface with a periodic configuration contains four slits filled with the FeCrAl fibrous material. Four porous elements with various thicknesses are separated by stainless steel plates with a thickness of 0.1 mm. The arrangement of meta-surface with one period is shown in FIG. 10. The FeCrAl fibrous material with the porosity of 0.91 and the fiber diameter of 12 μm is used to realize the acoustic meta-surface, whose acoustic properties have been validated, as shown in FIGS. 9(*a*) and 9(*b*). Based on the phase response requirements, the thicknesses of four elements are carefully designed as labeled in FIG. 10.

Figure 12A:
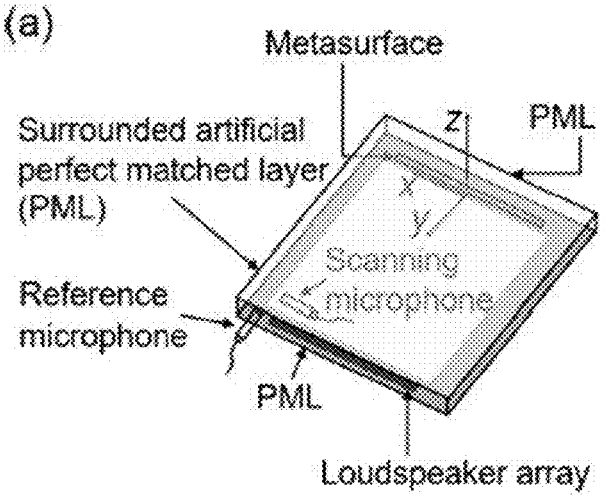
FIG. 12(*a*) shows a test rig for scanning a reflected sound pressure field.
Figure 12B:
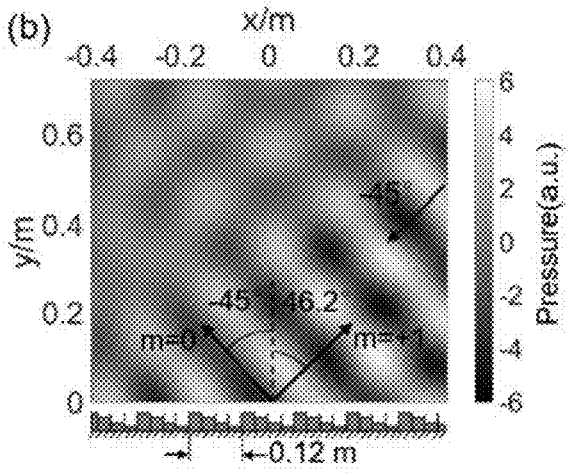
Figure 12C:
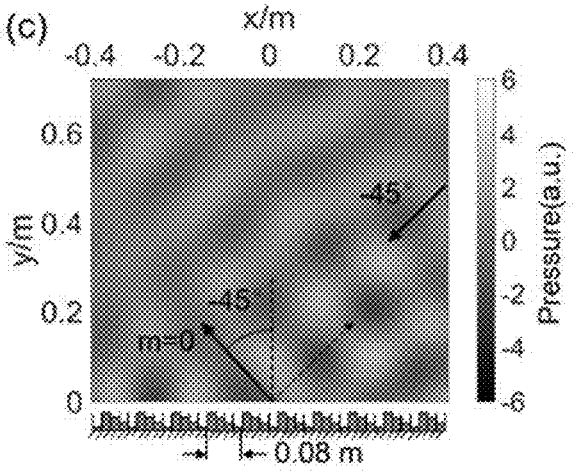

FIG. 12(*a*) shows a test rig for scanning a reflected sound pressure field. FIG. 12(*b*) shows an experimental result of a meta-surface with a period length of 0.12 m at a −45° incidence, and FIG. 12(*c*) shows an experimental result of a meta-surface with a period length of 0.08 m at a −45° incidence. Referring to FIG. 12(*a*), two plates with a distance of 3 cm generate a two-dimensional waveguide environment, allowing plane wave propagation under 5,700 Hz. White region is the scanning area and the starting line of scanning area is 4 cm away from the exiting surface of the whole meta-surface. Two simulated cases presented in FIGS. 11(*a*) and 11(*c*) are validated, which correspond to two meta-surfaces with the period lengths of 0.12 m ($\lambda_i$/d=1.429 at 2,000 Hz) and 0.08 m ($\lambda_i$/d=2.144 at 2,000 Hz) excited by a plane wave at a −45° incidence. The experimental results are shown in FIGS. 12(*b*) and 12(*c*), wherein the black arrows indicate the propagation directions. The small differences between the simulations (see, e.g., FIGS. 11(*a*) and 11(*c*)) and the measurements may come from the unavoidable background noise and reflections from the boundaries. In FIG. 12(*c*), some unexpected lobes with high amplitude in the bottom right corner may be caused by the non-uniform sound pressure level along the incident wavefront generated by the sound source. Still, comparing the simulations and the laboratory tests of two cases, good agreements are obtained including the number of reflected waves, their reflected angles and relative amplitudes of sound pressures, which will add confidence for studying on the sound absorption performance of the proposed meta-surface.

Sound Absorption Performance

Through simulations and laboratory tests, it has been demonstrated that the reflected waves can be controlled by adjusting the incident angle and the period length of meta-surface. For a meta-surface with the ratio $\lambda_i/d<2$, less acoustic energy is radiated into the acoustic far field due to the internal reflection of the $+1^{st}$ order diffracted wave carrying the most energy in a specific range of incident angles ($\theta_i \geq \theta_c$). It can make the meta-surface an effective device in noise reduction in this range of incident angles. For a meta-surface with the ratio $\lambda_i/d \geq 2$, the positive performance in the sound absorption can be obtained over a wider range of incident angle without the limitation of the critical angle, due to the disappearances of all the high-order diffracted waves (except for the specular reflection with m=0).

To evaluate sound absorption performance of the meta-surface quantitatively, the sound absorption coefficients at different incident angles are obtained at 2,000 Hz numerically at first. The periodic boundaries are set on the lateral sides of the computational domains to ensure continuity of sound field and eliminate the effects of boundaries on the sound absorption evaluation. As introduced before, good sound absorption is expected in a wider range of incident angles without the limitation of the critical angle for the meta-surface with the ratio $\lambda_i/d \geq 2$. Here, the meta-surface with the period length of 0.08 m ($\lambda_i/d=2.144>2$), which has been simulated and tested, is considered. By averaging the sound pressure in the whole reflection domain, the sound absorption coefficients over a wide range of incident angles (−80°~80°) can be obtained numerically, as shown in FIG. 13(*a*) (solid line).

Figure 13A:
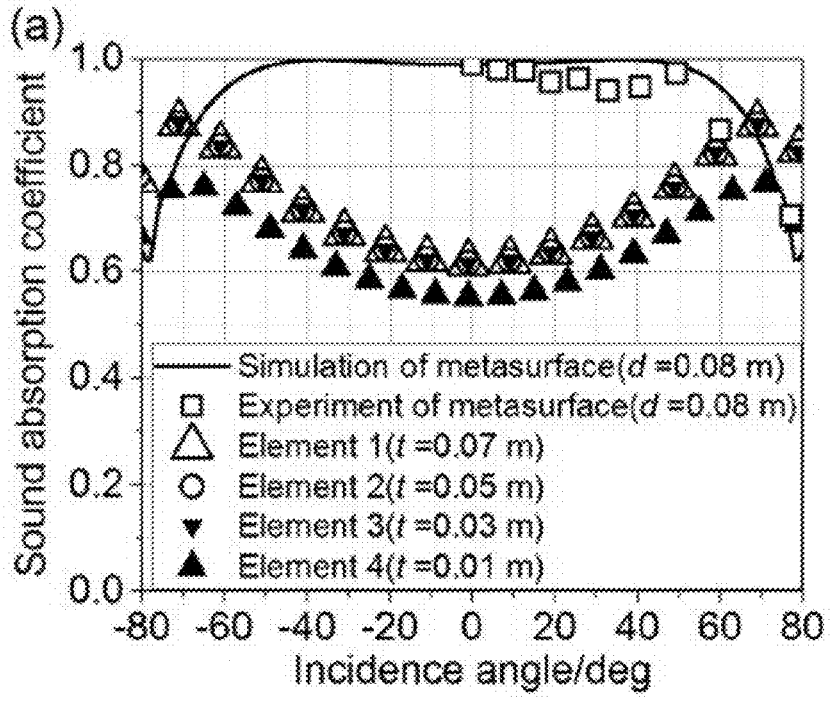
FIG. 13(*a*) shows a sound absorption coefficient with respect to an incidence angle at the designed frequency 2,000 Hz.
Figure 13B:
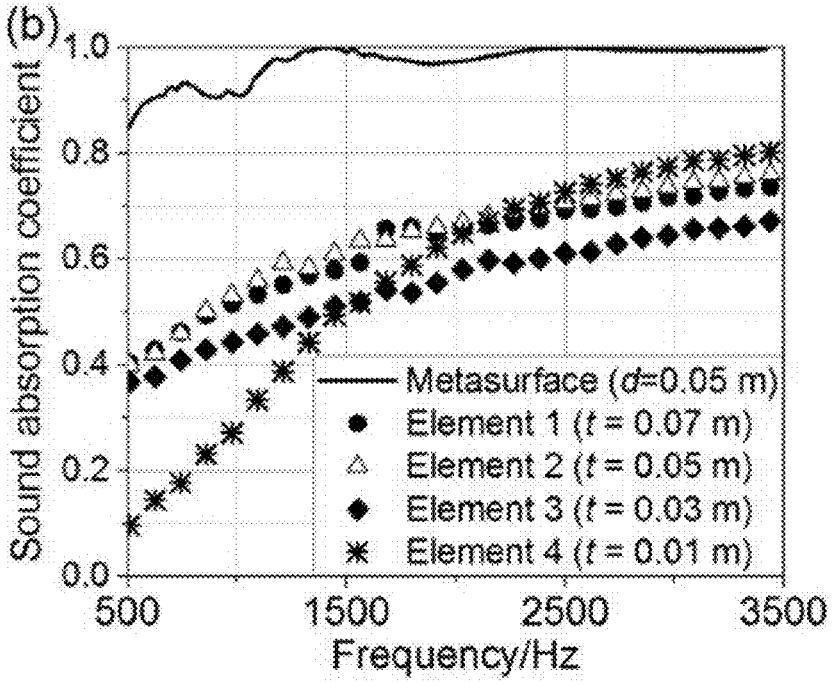

FIG. 13(*a*) shows a sound absorption coefficient with respect to an incidence angle at the designed frequency 2,000 Hz. FIG. 13(*b*) shows a sound absorption coefficient with respect to a frequency at the normal incidence. FIG. 13(*a*) shows an oblique-incidence sound absorption coefficients of the meta-surface with a period length of 0.08 m ($\lambda_i/d=2.144$) and four elements at 2,000 Hz, where a line shows simulation results of the meta-surface, an square shows experimental results of the meta-surfaces, and other symbols show simulation results of the individual elements. FIG. 13(*b*) shows sound absorption coefficients of the meta-surface with a period length of 0.05 m and four elements over broadband, where a line shows experimental results of the meta-surfaces and the symbols show experimental results of the individual elements.

The results show that the meta-surface possesses quasi-ominidirectionally perfect sound absorption at designed frequency of 2,000 Hz and the sound absorption coefficient can reach 0.98 between −50°~50°. To validate the simulated oblique-incidence sound absorption coefficient, a series of laboratory tests are conducted through reconstruction of the test rig shown in FIG. 12(*a*) (the details about the measurements can be found later) and the results are shown in FIG. 13(*a*) (square symbols), which match well with the simulations. Here, due to the symmetry of this physical problem, only the range of incident angles from 0° to 80° is considered in the test. The small differences between the simulated and the tested results may come from unavoidable reflections of the measured microphone and its support, and imperfect seal of boundaries. More details about tests on oblique-incidence sound absorption coefficient are introduced later.

Meanwhile, the sound absorption properties of four individual uniform elements with the various thicknesses are also evaluated through simulations, as shown in FIG. 13(*a*) (Elements 1-4). The acoustic parameters of used metal-based fibrous material (characteristic impedance $Z_c$ and wavenumber $k_c$), which exert a deciding influence on sound absorption coefficients, have been validated experimentally, as shown in FIGS. 10(*a*) and 10(*b*). It is able to guarantee accuracy of the simulated sound absorption coefficient of the uniform elements. Comparing with the four individual elements, the meta-surface shows the absolute advantage over the wide range of incident angles (about −65°~65°).

Besides the excellent sound absorption performance over the wide range of the incident angles at the designed frequency of 2,000 Hz, the structure with the stair-stepping configuration also shows potential on the broadband noise reduction, as shown in FIG. 13(*b*) (solid line). The tested results show that the sound absorption coefficient can exceed 0.9 when the frequency is larger than 600 Hz. Here, a structure with only one period is considered to evaluate the sound absorption property without consideration of periodicity. It is tested in a rectangular impedance tube, whose cross-section is a square with a side length of 0.05 m and this dimension can guarantee plane wave propagation inside the structure below 3430 Hz. For the tested samples, the period length is also changed to 0.05 m and it is in the range of $\lambda_i/d \geq 2$ when the frequency is lower than 3,430 Hz ($\lambda_i/d=2$ at 3,430 Hz). In the range of $\lambda_i/d \geq 2$, only the specular reflection exists when a plane wave incidents on the samples. It means that the sizes of the cross-section of the impedance tube and tested samples can ensure plane wave propagation inside the tube under 3,430 Hz, which is a necessary condition for measurements of sound absorption coefficient using the impedance tube. Although the phase responses of elements will change at other frequencies except for the target frequency of 2,000 Hz, and the phase gradient may be not linear anymore, the anomalous behaviors including the number of the reflected waves and their angles will not change once the period length is fixed. Thus, for the meta-surfaces with $\lambda_i/d \geq 2$, only the specular reflection exists over a range of broadband frequencies. However, it has been demonstrated that the phase gradient in one period has influence on energy distribution of the interested waves [25]. That is the reason why the sound absorption coefficient fluctuates over a broadband frequency range. Still, the sound absorption efficiency of the meta-surface remains at a high level. The four individual elements are also tested in a Brüel Kjær Type 4206 Two-microphone Impedance Measurement Tube and the results are shown in FIG. 13(*b*) (symbols). Comparing with all the four elements comprise it, the meta-surface shows advantage over a range of broadband frequencies.

Application

An acoustic porous meta-surface with the configuration of stair-stepping backed with a rigid wall is considered through analytical, numerical and experimental methods. It has been demonstrated by the simulations and laboratory tests that the meta-surface of the subject invention possesses the excellent sound absorption performance at the oblique incidences and over a broadband frequency range.

The design of the subject invention is a periodic structure comprising four slits filled with a metal-based fibrous material with varied thicknesses in one period. The thicknesses of four elements are designed to generate a uniform phase gradient within $2\pi$ on the upper surface of the whole structure so that the meta-surface can modulate the reflected waves at will. The reflected behaviors have been predicted analytically and proven by the numerical simulations and laboratory tests. Through changing the period length, the reflected behaviors including the number of reflected waves and their propagation directions can be adjusted, and the high-order waves can be prevented to radiate into the acoustic far field, which will result in good sound absorption property. It has been demonstrated that the meta-surface possesses a remarkable advantage on the sound absorption property over a wide range of incident angle at the interested frequency comparing with four individual elements. Besides the designed frequency, the designed structure with stair-stepping configuration also possesses potential in good sound absorption performance over a broadband frequency range.

Embodiments of the subject invention pave a way to realize effective noise reduction at the oblique incidences and over a broadband frequency range. The meta-surface of the subject invention has a high application value. The simple configuration and bulk material can make it easily employable on a large scale. The meta-surface is made of metal-based fibrous material that can be applied in hazard environments, e.g. high pressure and temperature, moisture, vibration and so on. Besides, the metal-based fibrous material can be shaped in fabrication process and the parameters can be customized based on requirements of space, weight, objective frequencies and mechanical properties. In all, it can be seen that the design of the subject invention has great potential to be applied for noise control in acoustics and sound isolation in the fields of architecture, ground transportation, and even aerospace in the future. It also provides more possibilities to design some other acoustic devices, e.g. acoustic black hole, acoustic cloak and acoustic diode. In additional to acoustic field, this work can also inspire designs and applications of optical and electromagnetic devices, e.g. optical lens and electromagnetic black hole, and other researches where the high efficiency of energy absorption is needed, e.g. solar panel for energy harvesting of light.

Reflected Sound Field Scanning Measurements

A test rig, which can provide a two-dimensional (2D) waveguide environment, is designed for scanning reflected sound pressure field, as shown in FIG. 12(*a*). It comprises two paralleled plexiglass plates (2,400 mm×1,200 mm×20 mm), with a gap of 30 mm. It ensures a plane wave propagation below 5,700 Hz. The wedge-shaped foam is placed at the available boundaries to minimize unnecessary reflections. A loudspeaker array (20*PUI audio AS04008CO-R) with a length of 80 cm is set up as the sound source of the plane wave. Two microphones (G.R.A.S type 46BE) are used for measurements: one is moved by a 2D traverse system from Parker Hannifin Corporation to scan the reflection region with a step of 12 mm in the x direction and 18 mm in the y direction, and the other is fixed near the loudspeaker array for measuring the sound pressure at the same time as a reference. The acquisition of sound pressure information is realized using National Instruments (NI) data acquisition system. Through analyzing the two signals and possessing the magnitude and phase information at the scanned positions, the sound pressure pattern in the reflection field can be obtained.

Numerical Simulation

The sound pressure fields of the meta-surface of the subject invention are simulated using a finite element solver COMSOL Multiphysics. Numerical models are established through solutions of the Helmholtz equation. The maximum element size is set as $\lambda_i/45$ to keep the accuracy and convergence of results. When the reflected behaviors are considered, the far field boundaries are enclosed by the perfect matched layers (PML) which can ensure minimum reflections into the computational domain. The PMLs on the lateral sides of computational domains are replaced by the periodic boundaries to ensure the continuity of sound field and eliminate the effects of boundaries on the sound absorption evaluation.

Supplementary Information

Firstly, the analytical model for obtaining the phase response of each element is given. The relationship between the phase response and acoustic characteristics of each element is built. Secondly, the surface waves near the meta-surfaces with different period lengths are presented. Thirdly, the reflected behaviors of the simulated cases with the Perfect Matched Layer (PML) and periodic boundaries on the lateral sides of the computational domains are compared. Next, the test rig and method for measuring oblique-incidence sound absorption coefficient at the interested frequency are introduced. Lastly, the rectangular impedance tube for measuring sound absorption coefficient over a broadband frequency range is presented.

Phase Response of Each Element

Figure 14:
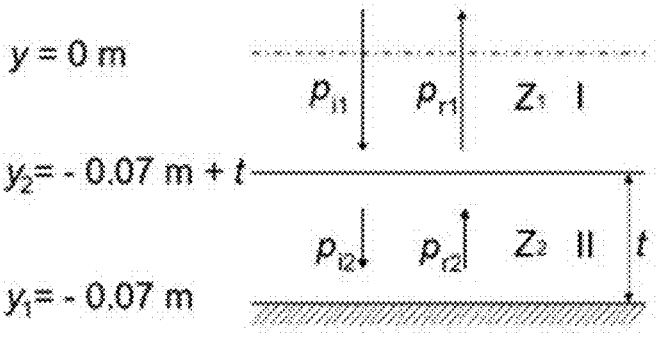
FIG. 14 shows an analytical model for obtaining a phase response of a reflected wave.

FIG. 14 shows an analytical model for obtaining a phase response of a reflected wave. A medium II with a thickness of t and the characteristic impedance of $Z_2$ is backed with a rigid wall. It is placed in medium I with the impedance of $Z_1$. An acoustic plane wave incidents on the medium II and it will be reflected on the upper surface ($y_2=-0.07+t$ m), as shown in FIG. 14.

The sound pressure fields in the media I and II can be expressed as an Equation 5:

$$P_I=p_{i1}+p_{r1}=A_{i1}e^{ik_1y}+A_{r1}e^{-ik_1y},$$

$$P_{II}=p_{i2}+p_{r2}=A_{i2}e^{ik_2(y-y_2)}+A_{r2}e^{-ik_2(y-y_2)}, \tag{5}$$

where $k_1$ and $k_2$ are the wavenumbers in media I and II. $A_i$ and $A_r$ represent the amplitudes of the incident and reflected sound pressures and the subscripts of 1 and 2 denote two media I and II. Using the boundary conditions at the interface $y_2=-0.07$ m+t (continuity of pressure and particle velocity) and the interface $y_1=-0.07$ m (particle velocity is zero), the reflected sound pressure at y=0 can be expressed as an Equation 6:

$$P_{r1(y=0)} = A_{i1}\frac{e^{2y_1ik_2}(Z_1+Z_2)-e^{2y_2ik_2}(Z_1-Z_2)}{e^{2y_2ik_2}(Z_1+Z_2)-e^{2y_1ik_2}(Z_1-Z_2)}e^{2y_2ik_1}, \tag{6}$$

In this work, $Z_2$ is the characteristic impedance of metal-based fibrous material and $Z_1$ is the impedance of air. $Z_2$ can be calculated by $Z_2=\rho_e c_e=\sqrt{(K_e\rho_e)}$, where $K_e$ and $\rho_e$ are the effective bulk modulus and density. These two parameters can be calculated by the Johnson-Champoux-Allard model (Equations 3 and 4) through known parameters: porosity $\phi$(−), flow resistivity $\sigma$(Nm−4s), tortuosity $\alpha_\infty$(−), viscous characteristic length Λ(m) and thermal characteristic length Λ'(m). For a certain martial sample with the known fiber diameter and porosity, these five parameters are obtained by a bottom-up approach. Thus, the relationship between the phase response and parameters of material is built.

The total thickness of the whole meta-surface is 0.07 m, as shown in FIG. 9. Although the thicknesses of four individual elements (t in FIG. 14) are various, the upper surface of the whole structure (y=0 m) labeled in FIG. 14 is selected to extract phase responses of all the four elements. Based on the selected thicknesses t shown in FIG. 9, the phase difference of π/2 can be formed between two adjacent elements and a total phase shift of 2π can be covered in one period containing four elements.

Surface Wave

The interested property of the meta-surface in the embodiments of the subject invention is the sound absorption capability. Thus, the reflection in the acoustic far field which plays a key role for the sound absorption efficiency is the concern. The simulated and tested areas are 4 cm away from the reflected interface of the meta-surface. Actually, the less reflection is caused by the conversions from some propagation waves to the surface waves, which can be observed clearly near the meta-surface. Considering the meta-surface with the period length of 0.12 m at the normal incidence and the other one with the period length of 0.08 m at a −45° incidence, corresponding to FIGS. 11(*b*) and 11(*c*), there exist the surface waves for both cases. The reflected sound pressure fields including the surface waves near the reflected interfaces are shown in FIGS. 15(*a*) and 15(*b*).

Figure 15A:
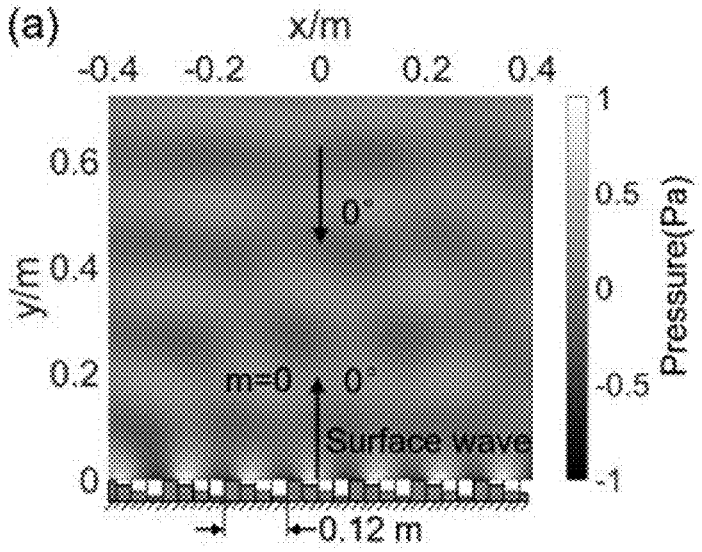
FIG. 15(*a*) shows a reflected sound pressure field including a surface wave near the reflected interfaces at normal incidence.
Figure 15B:
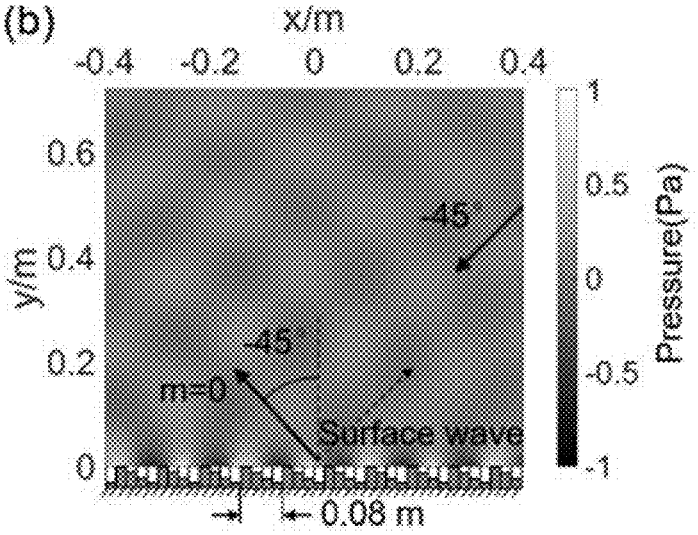

FIG. 15(*a*) shows a reflected sound pressure field including a surface wave near the reflected interfaces at normal incidence, where the period length of the meta-surface is 0.12 m ($\lambda_t$/d=1.429 at 2,000 Hz). FIG. 15(*b*) shows a reflected sound pressure field including a surface wave near the reflected interfaces at an −45° incidence, where the period length of the meta-surface is 0.08 m ($\lambda_t$/d=2.144 at 2,000 Hz).

Figure 16A:
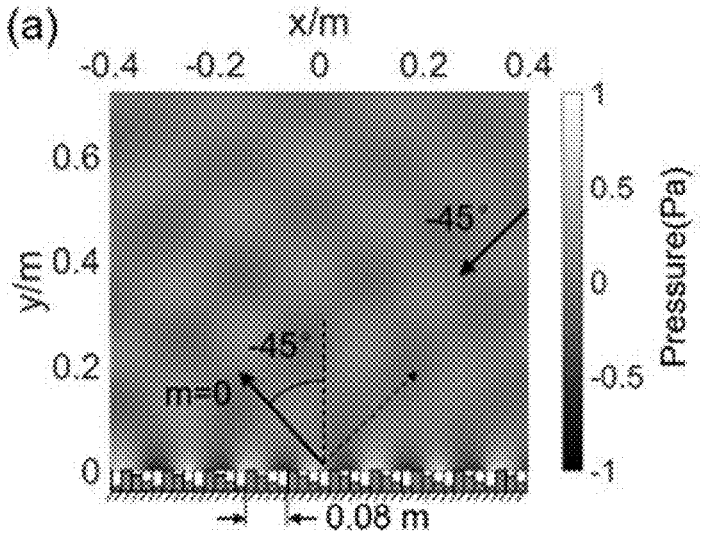
FIG. 16(*a*) shows a reflected sound pressure field when including perfect match layers (PMLs) on boundaries on the lateral sides at a simulated meta-surface with a period length of 0.08 in at a −45° incidence.
Figure 16B:
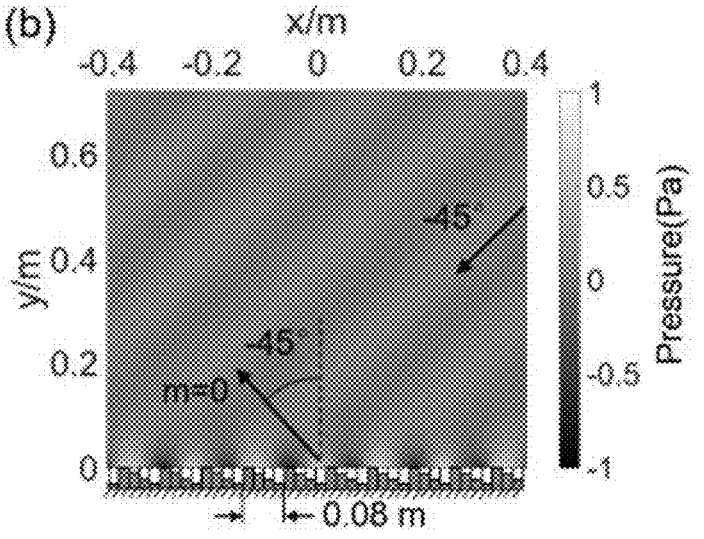

Reflected Sound Pressure Fields of the Simulated Cases with Various Boundary Conditions For the meta-surface with the period length of 0.08 m ($\lambda_t$/d=2.144), only the specular reflection should exist at the omni-directional incidences based on the diffraction theory, as shown in FIG. 1(*b*). However, an extra wave appears in the simulation when the boundaries on the lateral sides of the computational domains are set as Perfect Matched Layers (PMLs), as shown in FIGS. 11(*c*) and 16(*a*). If the PMLs are replaced by the periodic boundaries, the spurious wave will disappear and the result matches with the analytical prediction, that is, only the specular reflection exists, as shown in FIG. 16(*b*). So the extra wave is caused by the PML boundary condition. FIG. 16(*a*) shows a reflected sound pressure field of the meta-surface with the period length of 0.08 m at a −45° incidence when including perfect match layers (PMLs) on boundaries on the lateral sides. FIG. 16(*b*) shows a reflected sound pressure field of the meta-surface with the period length of 0.08 m at a −45° incidence when including periodic boundaries on boundaries on the lateral sides.

Figure 17:
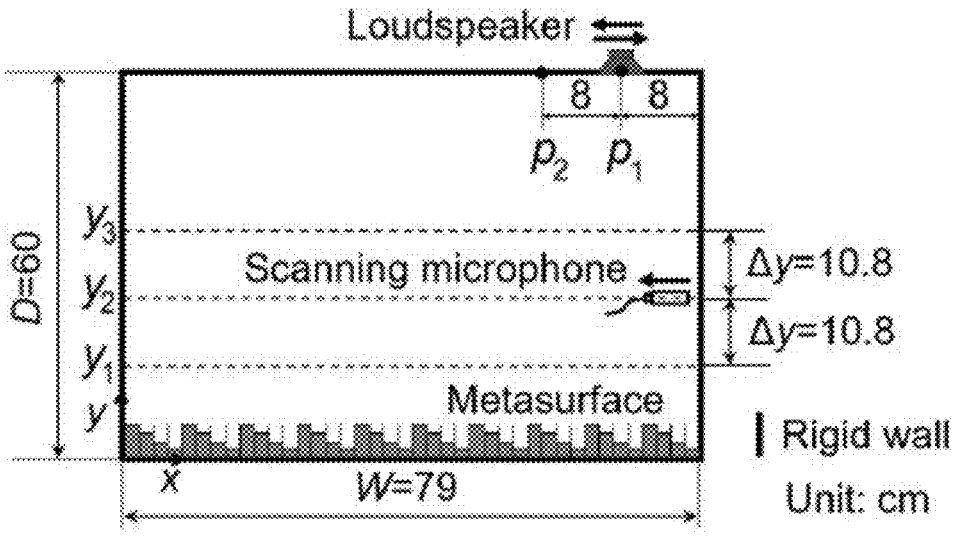
FIG. 17 shows a schematic of a test rig for measuring oblique-incidence sound absorption coefficient.

Experiments on Oblique-Incidence Sound Absorption Coeficient at the Designed Frequency The oblique-incidence sound absorption coefficient of the meta-surface is measured to validate the simulation results, as shown in FIG. 13(*a*). The method is based on the propagation mode expansion of two-dimensional acoustic field in a thin rectangular chamber [24]. The test rig for scanning reflected sound pressure field is reconstructed, which is shown in FIG. 17 that shows a schematic of a test rig for measuring oblique-incidence sound absorption coefficient. Referring to FIG. 17, in the space between two paralleled plates with the gap of 3 cm, a region with a length W of 79 cm and a width D of 60 cm is enclosed by the rigid plates. For the designed frequency of 2,000 Hz, there exist the modes with various orders in the x direction, which correspond to the varied incident angles by an Equation 7.

$$\theta_n = \sin^{-1}\left(\frac{k_x^n}{k}\right), \tag{7}$$

where k is wavenumber in the propagation direction of the plane wave and $k_x^n$ is the $n^{th}$ order wavenumber in the x direction within the chamber, which is defined as $k_x^n = n\pi/W$. For example, for the interested frequency 2,000 Hz, there exist the $0^{th}$-$9^{th}$ order modes which can cover incident angle range $\theta_n$ from 0° to 77°.

The oblique-incidence absorption coefficient α at the incident angle $\theta_n$ for each propagation mode can be obtained by using Equation 8.

$$\alpha(f, \theta_n) = 1 - \left|\frac{b_n}{a_n}\right|^2, \tag{8}$$

where $a_n$ and $b_n$ are the complex amplitudes of incident wave and reflected wave with the $n^{th}$ mode. They can be obtained by measuring the sound pressure on two lines along the x direction, such as $y=y_1$ and $y=y_2$, or $y=y_1$ and $y=y_3$ in FIG. 17. One loudspeaker (PUI audio AS04008CO-R) is mounted on the opposite side of meta-surface and it can be moved in the x direction. Two positions of loudspeakers (labeled as $p_1$ and $p_2$ in FIG. 17) are conducted to get the oblique-incidence sound absorption coefficient. For each fixed position of loudspeaker, three measurements are implemented on the three lines $y=y_1$, $y=y_2$ and $y=y_3$. The scanning microphone is moved by a two-dimensional traverse system from Parker Hannifin Corporation with a step of 12 mm in the x direction to get the sound pressures along three lines. And the input signal of loudspeaker is set as a reference for measurement in each point. The acquisition of sound pressure information is realized using National Instruments (NI) data acquisition system. Through selecting any two lines to calculate absorption coefficient, three sets of results can be obtained for each loudspeaker position. Based on measurements of two loudspeaker positions, the final results are obtained by averaging the six by the unexcited modes. The oblique-incidence sound absorption coefficient of the meta-surface with the period length of 0.08 m at 2,000 Hz is measured and the results are shown in FIG. 13(*a*).

Figure 18:
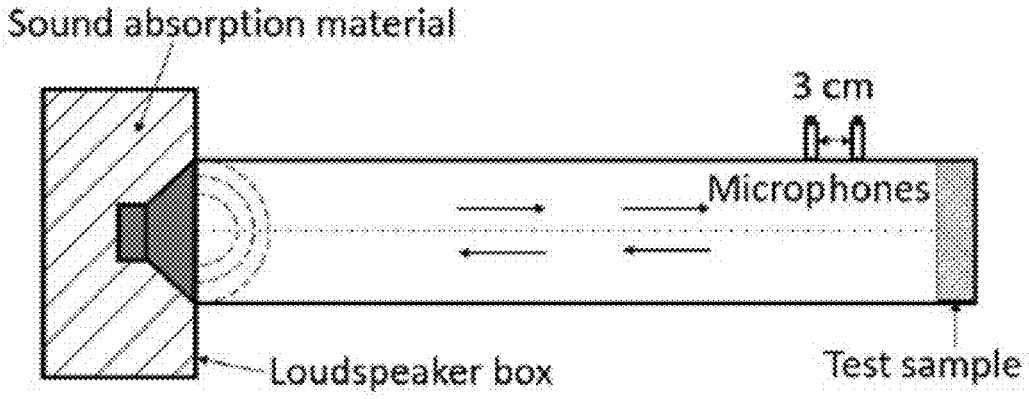
FIG. 18 shows a schematic of a rectangular impedance tube for measuring sound absorption coefficient of meta-surface over broadband.

Experiments on Sound Absorption Coefficient at Normal Incidence Over a Range of Broadband Frequencies In FIG. 13(*b*), the sound absorption coefficients of the meta-surface with a period length of 0.05 m and four individual elements are shown. The measurements of four elements with different thicknesses t are conducted in the Brüel Kjær Type 4206 Two-microphone Impedance Measurement Tube with a circular cross-section. For the meta-surface with non-uniform structure, an impedance tube with rectangular cross-section is designed as shown FIG. 18. FIG. 18 shows a schematic of a rectangular impedance tube for measuring sound absorption coefficient of meta-surface over broadband. Referring to FIG. 18, it is built by acrylic plates with a thickness of 2 cm. The cross-section is a square with a side length of 0.05 m, which can allow plane wave propagation below 3,430 Hz. The loudspeaker is mounted at one of the end. It is placed in an acrylic box with sound absorption foam inside to reduce vibration and sound leakage. Two microphones (G.R.A.S 46BD) are flush-mounted with a distance of 3 cm to get sound pressure. The sound absorption coefficient of the meta-surface with the period length of 0.05 m at normal incidence is measured over a range of broadband frequencies and the results are shown in FIG. 13(*b*).

It should be understood that the examples and embodiments described herein are for illustrative purposes only and that various modifications or changes in light thereof will be suggested to persons skilled in the art and are to be included within the spirit and purview of this application.

All patents, patent applications, provisional applications, and publications referred to or cited herein (including those in the "References" section) are incorporated by reference in their entirety, including all figures and tables, to the extent they are not inconsistent with the explicit teachings of this specification.

REFERENCES

[1] Cox, T. J. and D'antonio, P. "Acoustic Absorber And Diffusers: Theory, Design And Application," CRC Press, second edition, 2009.

[2] Cummer, S. A., Christensen, J., and Alù, A. "Controlling sound with acoustic metamaterials," Nat. Rev. Mater. 1:16001 (2016).

[3] Fok, L., Ambati, M. and Zhang, X. "Acoustic metamaterials," MRS Bulletin 33(10):931-934 (2008).

[4] Ma, G., Yang, M., Xiao, S., Yang, Z. and Sheng, P. "Acoustic metasurface with hybrid resonances," Nat. Mat. 13(9):873-878 (2014).

[5] Mei, J. et al. "Dark acoustic metamaterials as super absorbers for low-frequency sound," Nat. Commun. 3:756 (2012).

[6] Yang, Z., Dai, H. M., Chan, N. H., Ma, G. C. and Sheng, P. "Acoustic metamaterial panels for sound attenuation in the 50-1000 Hz regime," Appl. Phys. Lett. 96(4):041906 (2010).

[7] Yang, Z., Mei, J., Yang, M., Chan, N. H. and Sheng, P. "Membrane-type acoustic metamaterial with negative dynamic mass," Phys. Rev. Lett. 101(20):204301 (2008).

[8] Jiménez, n., Huang W., Romero-García, V., Pagneux, V. and Groby, J. P. "Ultra-thin metamaterial for perfect and quasi-omnidirectional sound absorption," Appl. Phys. Lett. 109(12):121902 (2016).

[9] Li, J., Wang, W., Xie, Y., Popa, B. I. and Cummer, S. A. "A sound absorbing metasurface with coupled resonators," Appl. Phys. Lett. 109(9):091908 (2016).

[10] Jiang, X. et al. "Ultra-broadband absorption by acoustic metamaterials," Appl. Phys. Lett. 105(24):243505 (2014).

[11] Ren, S. W., Meng, H., Xin, F. X. and Lu, T. J. "Ultrathin multi-slit metamaterial as excellent sound absorber: Influence of micro-structure," J. Appl. Phys. 119(1):014901 (2016).

[12] Tana, Y. et al. "Hybrid acoustic metamaterial as super absorber for broadband low-frequency sound," Sci. Rep. 7,43340 (2017).

[13] Christensen, J. et al. "Extraordinary absorption of sound in porous lamella-crystals," Sci. Rep. 4, 4674 (2014).

[14] Larouche, S. and Smith, D. R. "Reconciliation of generalized refraction with diffraction theory," Opt. Lett. 37(12):2391-2393 (2012).

[15] Yu, N. et al. "Light propagation with phase discontinuities: generalized laws of reflection and refraction," Science 334(6054):333-337 (2011).

[16] Champoux, Y., and Allard, J. F. "Dynamic tortuosity and bulk modulus in air-saturated porous media," J. Appl. Phys. 70(4):1975-1979 (1991).

[17] Johnson, D. L., Koplik, J. and Dashen, R. "Theory of dynamic permeability and tortuosity in fluid-saturated porous media," J. Fluid Mech. 176:379-402 (1987).

[18] Qiao, J. C., Xi, Z. P., Tang, H. P., Wang, J. Y., and Zhu, J. L. "Mechanical properties of porous stainless steel metal fiber media," In Mat. Sci. Forum 618:109-112 (2009).

[19] Perrot, C., Chevillotte, F. and Panneton, R. "Bottom-up approach for microstructure optimization of sound absorbing materials," J. Acoust. Soc. Am 124(2):940-948 (2008).

[20] Perrot, C., Chevillotte, F., and Panneton, R. "Dynamic viscous permeability of an open-cell aluminum foam: Computations versus experiments," J. Appl. Phys. 103(2): 024909 (2008).

[21] Perrot, C., Chevillotte, F., Panneton, R., Allard, J. F. and Lafarge, D. "On the dynamic viscous permeability tensor symmetry," J. Acoust Soc Am 124(4):EL210EL217 (2008).

[22] Liu, S., Chen, W. and Zhang, Y. "Design optimization of porous fibrous material for maximizing absorption of sounds under set frequency bands," Appl. Acous. 76:319-328 (2014).

[23] Bolton, J. S., Yoo, T., and Olivieri, O. "Measurement of normal incidence transmission loss and other acoustical properties of materials placed in a standing wave tube," Brüel & Kjær Technical Review (1):1-44 (2007).

[24] Inoue, N. and Sakuma, T. "Development of a measurement method for oblique-incidence sound absorption coefficient using a thin chamber," N0. 421, Buenos Aires (2016).

[25] Fang, Y., Zhang, X., Zhou, J. "Sound transmission through an acoustic porous metasurface with periodic structures," Appl. Phys. Lett. 110(17):171904 (2017).

What is claimed is:

1. A sound absorber, comprising:

a plurality of unit absorbers arranged in a first direction, each unit absorber comprising a plurality of absorber elements comprising first to $n^{th}$ absorber elements arranged in the first direction, each of the first to $n^{th}$ absorber elements having a different thickness; and a plurality of respectively disposed between the first to $n^{th}$ absorber elements in each unit absorber of the plurality of unit absorbers, wherein the thickness of the first to $n^{th}$ absorber elements in each unit absorber of the plurality of unit absorbers is the same as that of the first to $n^{th}$ absorber elements, respectively, in each other unit absorber of the plurality of unit absorbers, such that the plurality of unit absorbers extends in a periodic manner in the first direction, and wherein each wall of the plurality of walls comprises an acoustically reflective material.

2. The sound absorber according to claim 1, further comprising a back wall disposed on a bottom surface of the plurality of unit absorbers.

3. The sound absorber according to claim 1, wherein each absorber element of each unit absorber of the plurality of unit absorbers is made of a porous material.

4. The sound absorber according to claim 1, wherein the thicknesses of the first to $n^{th}$ absorber elements in each unit absorber of the plurality of unit absorbers are configured to form a linear phase gradient on an upper reflected surface of a whole structure of the sound absorber.

5. The sound absorber according to claim 4, wherein the thicknesses of the first to $n^{th}$ absorber elements in each unit absorber of the plurality of unit absorbers are configured to generate a phase shift of $2\pi/n$ between adjacent absorber elements.

6. The sound absorber according to claim 1, wherein a length of each unit absorber of the plurality of unit absorbers is smaller than a half wavelength of an incident wave.

7. The sound absorber according to claim 1, wherein the acoustically reflective material is at least one of a metal, a plexiglass, and a plastic.

8. The sound absorber according to claim 1, further comprising a cover layer with acoustic transparency disposed on the plurality of unit absorbers.

9. A sound absorber, comprising:

a plurality of unit absorbers arranged in a first direction and a second direction, each unit absorber comprising a plurality of absorber elements comprising first to $n^{th}$ absorber elements arranged in the first direction and first to $n^{th}$ absorber elements arranged in the second direction, each of the first to $n^{th}$ absorber elements having a different thickness; and a plurality of frames respectively disposed between the first to $n^{th}$ absorber elements in the first direction and the second direction in each unit absorber of the plurality of unit absorbers, wherein the thickness of the first to $n^{th}$ absorber elements in each unit absorber of the plurality of unit absorbers is the same as that of the first to $n^{th}$ absorber elements, respectively, in each other unit absorber of the plurality of unit absorbers, such that the plurality of unit absorbers extends in a periodic manner in the first direction and in the second direction, and wherein each frame of the plurality of frames comprises an acoustically reflective material.

10. The sound absorber according to claim 9, further comprising a back wall disposed on a bottom surface of the plurality of unit absorbers.

11. The sound absorber according to claim 9, wherein each absorber element of each unit absorber of the plurality of unit absorbers is made of a porous material.

12. The sound absorber according to claim 9, wherein a length of each unit absorber of the plurality of unit absorbers in the first direction is the same as a length of each unit absorber of the plurality of unit absorbers in the second direction.

13. The sound absorber according to claim 12, wherein the thicknesses of the first to $n^{th}$ absorber elements in each unit absorber of the plurality of unit absorbers are configured to form a first linear phase gradient and a second linear phase gradient on an upper reflected surface of a whole structure in the first direction and the second direction, respectively.

14. The sound absorber according to claim 13, wherein the thicknesses of the first to $n^{th}$ absorber elements in each unit absorber of the plurality of unit absorbers are configured to generate a phase shift of $2\pi/n$ between adjacent absorber elements.

15. The sound absorber according to claim 14, wherein each unit absorber of the plurality of unit absorbers is smaller, in both the first direction and the second direction, than a half wavelength of an incident wave.

16. The sound absorber according to claim 9, wherein an upper surface of each absorber of each unit absorber of the plurality of unit absorbers has a square shape.

17. The sound absorber according to claim 9, wherein the acoustically reflective material is at least one of a metal, a plexiglass, and a plastic.

18. The sound absorber according to claim 9, further comprising an acoustically transparent cover layer disposed on the plurality of unit absorbers.

* * * * *